US010865983B2

(12) United States Patent
Benzeval

(10) Patent No.: US 10,865,983 B2
(45) Date of Patent: Dec. 15, 2020

(54) INLET ASSEMBLY

(71) Applicant: Edwards Limited, Burgess Hill (GB)

(72) Inventor: Ian David Benzeval, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 143 days.

(21) Appl. No.: 16/302,488

(22) PCT Filed: Apr. 24, 2017

(86) PCT No.: PCT/GB2017/051132
§ 371 (c)(1),
(2) Date: Nov. 16, 2018

(87) PCT Pub. No.: WO2017/198997
PCT Pub. Date: Nov. 23, 2017

(65) Prior Publication Data

US 2019/0285272 A1 Sep. 19, 2019

(30) Foreign Application Priority Data

May 18, 2016 (GB) ..... 1608714

(51) Int. Cl.
*F23D 14/08* (2006.01)
*F23D 14/58* (2006.01)
(Continued)

(52) U.S. Cl.
CPC ..... *F23D 14/583* (2013.01); *F23D 14/02* (2013.01); *F23D 14/08* (2013.01); *F23D 14/12* (2013.01);
(Continued)

(58) Field of Classification Search
CPC ..... F23D 14/583; F23D 14/12; F23D 14/64; F23D 14/70; F23D 17/08; F23D 2203/005; F23D 2206/00
(Continued)

(56) References Cited

U.S. PATENT DOCUMENTS 3,619,094 A 11/1971 Lientz
RE27,507 E * 10/1972 Turpin ..... F23G 7/085 431/202
(Continued)

FOREIGN PATENT DOCUMENTS

CN 1298434 C 2/2007
EP 0335728 A2 10/1989
(Continued)

OTHER PUBLICATIONS

First Office Action dated Jul. 17, 2019 and Search Report dated Jul. 8, 2019 for Chinese application Serial No. 201780030585.3.
(Continued)

*Primary Examiner* — Avinash A Savani
(74) *Attorney, Agent, or Firm* — Theodore M. Magee; Westman, Champlin & Koehler, P.A.

(57) ABSTRACT

An inlet assembly for a burner includes an inlet nozzle defining an inlet aperture, a non-circular outlet aperture, and a nozzle bore extending along a longitudinal axis between the inlet aperture and the outlet aperture for conveying an effluent gas stream from the inlet aperture to the outlet aperture for delivery to the combustion chamber of the burner. The nozzle bore extends from the inlet aperture to the non-circular outlet aperture. A baffle couples the inlet portion with the outlet portion, and defines a baffle aperture positioned within the nozzle bore. The baffle aperture has a reduced cross-sectional area compared to that of the outlet portion adjacent the baffle. A secondary gas stream nozzle provides a secondary gas stream. The secondary gas stream nozzle being positioned to mix the secondary gas stream with the effluent gas stream within the nozzle bore.

9 Claims, 21 Drawing Sheets

(51) Int. Cl.

| | |
|---|---|
| ***F23D 14/12*** | (2006.01) |
| ***F23D 14/64*** | (2006.01) |
| ***F23D 14/70*** | (2006.01) |
| ***F23D 14/02*** | (2006.01) |
| ***F23G 7/06*** | (2006.01) |

(52) U.S. Cl.
CPC ..... *F23D 14/64* (2013.01); *F23D 14/70* (2013.01); *F23G 7/065* (2013.01); *F23D 2203/005* (2013.01); *F23D 2206/00* (2013.01)

(58) Field of Classification Search
USPC ..... 431/354
See application file for complete search history.

(56) References Cited

U.S. PATENT DOCUMENTS

| | | | | |
|---|---|---|---|---|
| 3,881,870 | A * | 5/1975 | Hatfield | F23G 7/065 422/168 |
| 5,289,976 | A * | 3/1994 | Dou | B01J 8/1827 239/431 |
| 5,380,194 | A * | 1/1995 | Polomchak | F23D 14/02 239/404 |
| 2006/0104879 | A1 | 5/2006 | Chiu et al. | |
| 2010/0291492 | A1 * | 11/2010 | Poe | F23G 7/085 431/5 |
| 2012/0324863 | A1 | 12/2012 | Winkler et al. | |

FOREIGN PATENT DOCUMENTS

| | | | |
|---|---|---|---|
| EP | 0694735 | A1 | 1/1996 |
| EP | 0985876 | A1 | 3/2000 |
| EP | 2684594 | A1 | 1/2014 |
| GB | 2533293 | A | 12/2014 |
| GB | 2516267 | A | 1/2015 |
| JP | H11118128 | A | 4/1999 |
| JP | 2001153312 | A | 6/2001 |
| WO | 2008122819 | A1 | 10/2005 |
| WO | 2011151735 | A1 | 12/2011 |
| WO | 2014016566 | A2 | 1/2014 |
| WO | 2015008022 | A1 | 1/2015 |

OTHER PUBLICATIONS

British Search Report dated Nov. 18, 2016 and Examination Report dated Nov. 21, 2016 for corresponding British Application No. GB1608714.0.

PCT Search Report and Written Opinion dated Jul. 7, 2017 for corresponding PCT Application No. PCT/GB2017/051132.

Taiwanese Office Action dated Aug. 27, 2020 for corresponding Taiwanese application Serial No. 106115957.

* cited by examiner

INLET ASSEMBLY

CROSS-REFERENCE OF RELATED APPLICATION

This application is a Section 371 National Stage Application of International Application No. PCT/GB2017/051132, filed Apr. 24, 2017, which is incorporated by reference in its entirety and published as WO 2017/198997 A1 on Nov. 23, 2017 and which claims priority of British Application No. 1608714.0, filed May 18, 2016.

FIELD

The present invention relates to an inlet assembly for a burner and a method.

BACKGROUND

Radiant burners are known and are typically used for treating an effluent gas stream from a manufacturing process tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity.

Known radiant burners use combustion to remove the PFCs and other compounds from the effluent gas stream. Typically, the effluent gas stream is a nitrogen stream containing PFCs and other compounds. A fuel gas is mixed with the effluent gas stream and that gas stream mixture is conveyed into a combustion chamber that is laterally surrounded by the exit surface of a foraminous gas burner. Fuel gas and air are simultaneously supplied to the foraminous burner to affect flameless combustion at the exit surface, with the amount of air passing through the foraminous burner being sufficient to consume not only the fuel gas supplied to the burner, but also all the combustibles in the gas stream mixture injected into the combustion chamber.

The range of compounds present in the effluent gas stream and the flow characteristics of that effluent gas stream can vary from process tool to process tool, and so the range of fuel gas and air, together with other gases or fluids that need to be introduced into the radiant burner will also vary.

Although techniques exist for processing the effluent gas stream, they each have their own shortcomings. Accordingly, it is desired to provide an improved technique for processing an effluent gas stream.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided an inlet assembly for a burner, the inlet assembly comprising: an inlet nozzle defining an inlet aperture coupleable with an inlet conduit providing an effluent gas stream for treatment by the burner, a non-circular outlet aperture, a nozzle bore extending along a longitudinal axis between the inlet aperture and the outlet aperture for conveying the effluent gas stream from the inlet aperture to the outlet aperture for delivery to the combustion chamber of the burner, the nozzle bore having an inlet portion extending from the inlet aperture and an outlet portion extending to the non-circular outlet aperture, a baffle coupling the inlet portion with the outlet portion, the baffle defining a baffle aperture positioned within the nozzle bore, the baffle aperture having a reduced cross-sectional area compared to that of the outlet portion adjacent the baffle, and a secondary gas stream nozzle coupleable with a secondary gas stream conduit providing a secondary gas stream, the secondary gas stream nozzle being positioned to mix the secondary gas stream with the effluent gas stream within the nozzle bore.

The first aspect recognises that the processing of effluent gases can be problematic, particularly as the flow of those effluent gases increases. For example, a processing tool may output five effluent gas streams for treatment, each with a flow rate of up to 300 litres per minute (i.e. 1,500 litres per minute in total). However, existing burner inlet assemblies typically have four or six nozzles, each capable of supporting a flow rate of around only 50 litres per minute (enabling treatment of only 200 to 300 litres per minute in total). This is because the effluent treatment mechanism typically relies on a diffusion process within the radiant burner; the combustion by-products need to diffuse into the effluent stream in order to perform the abatement reaction. In other words, the combustion by-products need to diffuse from an outer surface of the effluent stream, all the way into the effluent stream, and then react with the effluent stream, before the effluent stream exits the radiant burner. Failure to completely diffuse into the effluent stream reduces the abatement efficacy. If the flow rates through the existing nozzles were increased to accommodate the increased amount of effluent stream, then the length of the radiant burner would need to increase proportionately to ensure the diffusion and reaction could occur prior to the faster-moving effluent stream exiting the radiant burner. Likewise, if the diameter of the existing nozzles were increased to accommodate the increased amount of effluent stream, then the length of the radiant burner would need to increase proportionately due to the increased time taken for the diffusion and reaction to occur in the larger diameter effluent stream.

Accordingly, an inlet assembly for a burner is provided. The inlet assembly may comprise an inlet nozzle. The inlet nozzle may define or be shaped to provide an inlet aperture or opening. The inlet aperture may couple or connect with the inlet conduit which provides an effluent gas stream to be treated by the burner. The inlet nozzle may also define or be shaped to provide a non-circular outlet aperture. The inlet nozzle may also define or be shaped to provide a nozzle bore which extends between the inlet aperture and the outlet aperture. The nozzle bore may extend along a longitudinal or effluent gas stream flow axis to convey the effluent stream from the inlet aperture to the outlet aperture in order to be delivered to the combustion chamber of the burner. The nozzle bore may also be formed of an inlet portion extending from or proximate to the inlet aperture. The nozzle bore may also have an outlet portion which extends or is proximate to the non-circular outlet aperture. The inlet nozzle may also have a secondary gas stream nozzle which may couple or connect with a secondary gas stream conduit which provides a secondary gas stream. The secondary gas stream nozzle may be positioned or located to mix, blend or combine the secondary gas stream and the effluent gas stream within the nozzle bore. In this way, the non-circular outlet aperture provides a non-circular effluent gas stream flow mixed with the secondary gas into the combustion chamber. The non-circular effluent gas flow enables a greater volume of effluent gas stream mixed with the secondary gas to be introduced into the combustion chamber while still achieving or exceeding the required levels of abatement. This is because a non-circular effluent gas stream provides a reduced distance along which diffusion and reaction needs to occur compared to that of an equivalent circular effluent gas stream. Hence, an increased volume of effluent gas stream can be abated, compared to that of an equivalent circular effluent gas stream and secondary gas stream mix.

In one embodiment, the secondary gas stream nozzle is located to intersect the effluent gas stream with the secondary gas stream. Accordingly, the secondary gas stream nozzle may be located or positioned so that the effluent gas stream flow and the secondary gas stream flow intersect, cross or overlap in order to improve the mixing of the secondary gas stream with the effluent gas stream.

In one embodiment, the secondary gas stream nozzle is orientated to inject the secondary gas stream transverse to the longitudinal axis. Accordingly, the secondary gas stream nozzle may be orientated or positioned to inject or provide the secondary gas stream flow in a direction which is transverse, oblique or inclined to the longitudinal axis along which the effluent gas stream generally flows. Again, this helps improve the mixing of the secondary gas stream with the effluent gas stream.

In one embodiment, the baffle aperture is configured to generate a vortex in the effluent gas stream within the outlet portion and the secondary gas stream nozzle is positioned to inject the secondary gas stream to flow tangentially to the vortex. Accordingly, the baffle aperture may be configured or arranged to generate a vortex, turbulence or eddy in the gas stream within the outlet portion. Such a vortex may be generated during the expansion of the effluent gas stream when exiting the baffle aperture. The secondary gas stream nozzle may be positioned, orientated or located to inject or provide the secondary gas stream in a direction which flows tangentially to an intersecting portion of the vortex.

In one embodiment, the secondary gas stream nozzle is positioned to inject the secondary gas stream to flow tangentially with a direction of flow of the vortex. Accordingly, the secondary gas stream nozzle may be positioned, located or orientated to inject or provide the secondary gas stream in a direction which flows tangentially together with the direction of flow of the intersecting portion the vortex. Accordingly, the secondary gas stream may flow with that portion of the vortex to help to propagate the vortex, which further assists stable mixing of the secondary gas stream with the effluent gas stream.

In one embodiment, the vortex has an inner flow region proximate the baffle aperture and an outer flow region proximate the outlet portion nozzle bore and the secondary gas stream nozzle is positioned to inject the secondary gas stream to flow tangentially with a direction of flow of the vortex in the inner flow region. Accordingly, the vortex may have two regions or portions. An inner flow region may be provided radially innermost, nearest the baffle aperture and an outer flow region may be provided radially outermost, nearest the outlet portion nozzle bore. The secondary gas stream nozzle may be positioned, located or orientated to inject or provide the secondary gas stream flow in a direction which is tangential to the direction of flow of the vortex in the inner flow region. This helps to improve the mixing of the secondary gas stream with the effluent gas stream in a stable manner.

In one embodiment, the secondary gas stream nozzle is positioned proximate the baffle. Accordingly, the secondary gas stream may be positioned or located proximate, near to or adjacent to the baffle. This helps to ensure that the secondary gas stream is introduced at a point where the mixing is most vigorous.

In one embodiment, the secondary gas stream nozzle is positioned within at least one of the inlet portion and the outlet portion. Accordingly, the secondary gas stream nozzle may be positioned within either the inlet portion or the outlet portion, or secondary gas stream nozzles may be placed in both.

In one embodiment, the secondary gas stream nozzle is orientated to inject the secondary gas stream at an angle of between 0° and 90° to the longitudinal axis. Accordingly, the secondary gas stream nozzle may be orientated, located or positioned to inject or provide the secondary gas stream flow at an angle from 0° to 90° with respect to the direction of flow of the effluent gas stream. This helps to mix the secondary gas stream with the effluent gas stream.

In one embodiment, the secondary gas stream nozzle is orientated to inject the secondary gas stream at an angle of between 10° and 40° to the longitudinal axis. In one embodiment, the secondary gas stream nozzle is orientated to inject the secondary gas stream at an angle of between 10° and 30° to the longitudinal axis. In one embodiment, the secondary gas stream nozzle is orientated to inject the secondary gas stream at an angle of between 15° and 30° to the longitudinal axis. Accordingly, the secondary gas stream may be orientated, located or positioned to provide the secondary gas stream flowing at an angle with respect to the direction of flow of the effluent gas stream.

In one embodiment, the outlet aperture is elongate, extending along a major axis and secondary gas stream nozzle is orientated to inject the secondary gas stream within a plane defined by the major axis. Accordingly, the secondary gas stream nozzle may be orientated, positioned or located to provide the secondary gas stream flow within a plane extending through the major axis of the elongate outlet aperture. This helps to provide for stable mixing.

In one embodiment, the secondary gas stream nozzle is positioned within the outlet portion, proximate the baffle aperture. Accordingly, the secondary gas stream nozzle may be positioned within the outlet portion proximate, near to or adjacent to the baffle aperture.

In one embodiment, the secondary gas stream nozzle comprises one of an aperture and a lance. It will be appreciated that a variety of structures may support the introduction of the secondary gas stream.

In one embodiment, the inlet assembly comprises a plurality of the gas stream nozzles. Accordingly, more than one gas stream nozzle may be provided. In one embodiment, at least one pair of gas stream nozzles are provided which am symmetrically located about the longitudinal axis.

In one embodiment, the baffle aperture is configured to generate a plurality of vortices in the effluent gas stream within the outlet portion and each secondary gas stream nozzle is positioned to inject the secondary gas stream to flow tangentially to one of the vortices. Accordingly, a secondary gas stream nozzle may be positioned, located or orientated to provide a secondary gas stream to each of the vortices.

In one embodiment, a cross-sectional area of the inlet portion reduces along the longitudinal axis from the inlet aperture towards the outlet portion.

In one embodiment, a cross-sectional shape of the inlet portion transitions along the longitudinal axis from a shape of the inlet aperture to a shape of the outlet aperture. Providing a gradual transition with no discontinuities from the shape of the inlet aperture to the shape of the outlet aperture helps maintain a laminar flow and minimizes deposits caused by residues within the effluent stream.

In one embodiment, the inlet aperture is circular. It will be appreciated that the inlet aperture may be any shape which matches that of the conduit providing the effluent stream.

In one embodiment, the outlet aperture is elongate. Providing an elongate shaped outlet aperture helps to minimize the diffusion distance of the similarly-shaped effluent stream.

In one embodiment, the outlet aperture is a generally quadrilateral slot. This provides a similarly-shaped effluent stream with is wide and narrow, providing both a greater flow rate whilst minimising the distance from any point with the effluent stream to an edge of the effluent stream.

In one embodiment, the outlet aperture is an obround. An obround, which is a shape consisting of two semicircles connected by parallel lines tangent to their endpoints, provides an effluent stream with a predictable distance along which diffusion and reaction needs to occur within that effluent stream.

In one embodiment, the outlet aperture is formed from a plurality of co-located, discrete apertures. It will be appreciated that the outlet aperture could be formed from separate, but co-located, smaller apertures.

In one embodiment, a cross-sectional area of the outlet portion changes along the longitudinal axis from the outlet aperture towards the inlet portion.

In one embodiment, the cross-sectional area of the outlet portion reduces along the longitudinal axis from the outlet aperture towards the inlet portion.

In one embodiment, the inlet assembly comprises a baffle coupling the inlet portion with the outlet portion, the baffle defining a baffle aperture positioned within the nozzle bore, the baffle aperture having a reduced cross-sectional area compared to that of the outlet portion adjacent the baffle. Placing a baffle or restriction within the nozzle bore provides an obstruction and a discontinuity so that an expansion of flow occurs within the downstream outlet portion which helps to shape the effluent stream to minimize the diffusion distance.

In one embodiment, a cross-sectional area of the inlet portion reduces along the longitudinal axis from the inlet aperture towards the outlet portion to match the cross-sectional area of the baffle aperture. Accordingly, the size and the shape of the inlet portion may change to match that of the baffle aperture in order to further minimize the risks of deposits due to residues in the effluent stream.

In one embodiment, a cross-sectional shape of the inlet portion transitions along the longitudinal axis from a shape of the inlet aperture to a shape of the baffle aperture.

In one embodiment, a shape of the baffle aperture matches that of the outlet portion adjacent the baffle.

In one embodiment, the baffle aperture is formed from a plurality of co-located apertures. Accordingly, the baffle aperture may be formed from co-located but discrete apertures.

In one embodiment, the baffle is configured to provide the baffle aperture having a changeable cross-sectional area. Hence, the size of the baffle aperture may be varied or changed in order to suit the operating conditions.

In one embodiment, the baffle comprises a shutter operable to provide the changeable cross-sectional area.

In one embodiment, the shutter is biased to provide the changeable cross-sectional area which varies in response a velocity of the effluent gas stream. Accordingly, the area of the baffle aperture may change automatically in response to the flow rate of the effluent gas stream.

According to a second aspect, there is provided a method, comprising: providing an inlet assembly for a burner, the inlet assembly comprising an inlet nozzle defining an inlet aperture coupleable with an inlet conduit providing an effluent gas stream for treatment by the burner, a non-circular outlet aperture, a nozzle bore extending along a longitudinal axis between the inlet aperture and the outlet aperture for conveying the effluent gas stream from the inlet aperture to the outlet aperture for delivery to the combustion chamber of the burner, the nozzle bore having an inlet portion extending from the inlet aperture and an outlet portion extending to the non-circular outlet aperture, a baffle coupling the inlet portion with the outlet portion, the baffle defining a baffle aperture positioned within the nozzle bore, the baffle aperture having a reduced cross-sectional area compared to that of the outlet portion adjacent the baffle, and a secondary gas stream nozzle coupleable with a secondary gas stream conduit providing a secondary gas stream, the secondary gas stream nozzle being positioned to mix the secondary gas stream with the effluent gas stream within the nozzle bore; and supplying the effluent gas stream to the inlet aperture and the secondary gas stream to the secondary gas stream nozzle.

In one embodiment, the method comprises locating the secondary gas stream nozzle to intersect the effluent gas stream with the secondary gas stream.

In one embodiment, the method comprises orientating the secondary gas stream nozzle to inject the secondary gas stream transverse to the longitudinal axis.

In one embodiment, the method comprises generating a vortex in the effluent gas stream within the outlet portion with the baffle aperture and positioning the secondary gas stream nozzle to inject the secondary gas stream to flow tangentially to the vortex.

In one embodiment, the method comprises positioning the secondary gas stream nozzle to inject the secondary gas stream to flow tangentially with a direction of flow of the vortex.

In one embodiment, the vortex is generated to have an inner flow region proximate the baffle aperture and an outer flow region proximate the outlet portion nozzle bore and the method comprises positioning the secondary gas stream nozzle to inject the secondary gas stream to flow tangentially with a direction of flow of the vortex in the inner flow region.

In one embodiment, the method comprises positioning the secondary gas stream nozzle proximate the baffle.

In one embodiment, the method comprises positioning the secondary gas stream nozzle within at least one of the inlet portion and the outlet portion.

In one embodiment, the method comprises orientating the secondary gas stream nozzle to inject the secondary gas stream at an angle of between 0° and 90° to the longitudinal axis.

In one embodiment, the outlet aperture is elongate, extending along a major axis and the method comprises orientating the secondary gas stream nozzle to inject the secondary gas stream within a plane defined by the major axis.

In one embodiment, the method comprises orientating the secondary gas stream nozzle to inject the secondary gas stream at an angle of between 10° and 40°, preferably between 10° and 30°, and more preferably between 15° and 30° to the longitudinal axis.

In one embodiment, the method comprises positioning the secondary gas stream nozzle within the outlet portion, proximate the baffle aperture.

In one embodiment, the secondary gas stream nozzle comprises one of an aperture and a lance.

In one embodiment, the method comprises providing a plurality of the gas stream nozzles.

In one embodiment, the method comprises generating a plurality of vortices in the effluent gas stream within the outlet portion with the baffle aperture and positioning each secondary gas stream nozzle to inject the secondary gas stream to flow tangentially to one of the vortices.

In one embodiment, a cross-sectional area of the inlet portion reduces along the longitudinal axis from the inlet aperture towards the outlet portion.

In one embodiment, a cross-sectional shape of the inlet portion transitions along the longitudinal axis from a shape of the inlet aperture to a shape of the outlet aperture.

In one embodiment, the inlet aperture is circular.

In one embodiment, the outlet aperture is elongate.

In one embodiment, the outlet aperture is a generally quadrilateral slot.

In one embodiment, the outlet aperture is an obround.

In one embodiment, the method comprises forming the outlet aperture from a plurality of co-located, discrete apertures.

In one embodiment, a cross-sectional area of the outlet portion changes along the longitudinal axis from the outlet aperture towards the inlet portion.

In one embodiment, the cross-sectional area of the outlet portion reduces along the longitudinal axis from the outlet aperture towards the inlet portion.

In one embodiment, a cross-sectional area of the inlet portion reduces along the longitudinal axis from the inlet aperture towards the outlet portion to match the cross-sectional area of the baffle aperture.

In one embodiment, a cross-sectional shape of the inlet portion transitions along the longitudinal axis from a shape of the inlet aperture to a shape of the baffle aperture.

In one embodiment, a shape of the baffle aperture matches that of the outlet portion adjacent the baffle.

In one embodiment, the method comprises forming the baffle aperture from a plurality of co-located apertures.

In one embodiment, the baffle is configured to provide the baffle aperture having a changeable cross-sectional area.

In one embodiment, the baffle comprises a shutter operable to provide the changeable cross-sectional area.

In one embodiment, the method comprises biasing the shutter to provide the changeable cross-sectional area which varies in response a velocity of the effluent gas stream.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
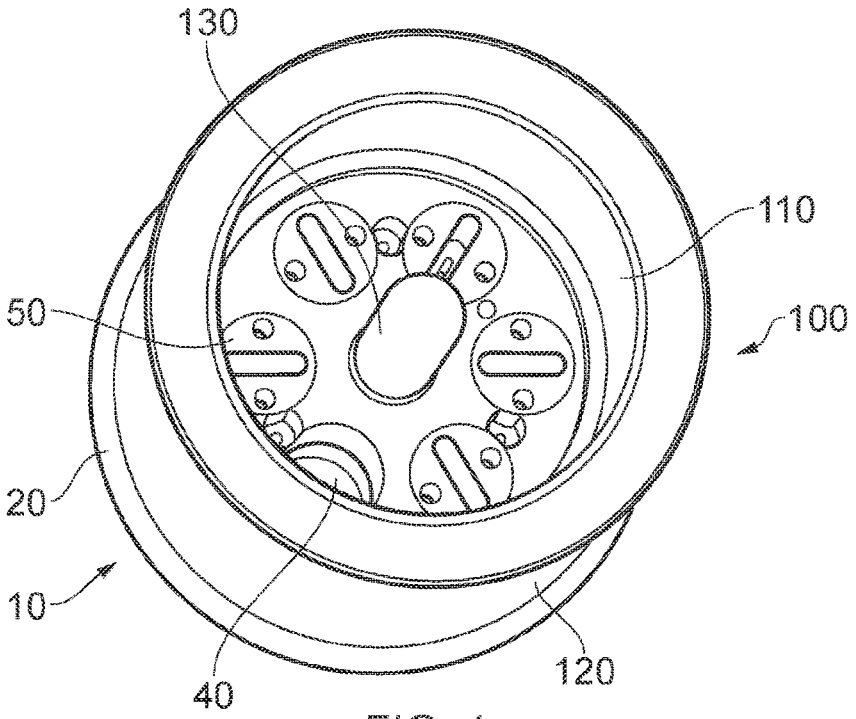
FIG. 1 is a perspective view showing the underside of a head assembly and burner according to one embodiment.

Before discussing the embodiments in any more detail, first an overview will be provided. Embodiments provide a burner inlet assembly. Although the following embodiments describe the use of radiant burners, it will be appreciated that the inlet assembly may be used with any of a number of different burners such as, for example, turbulent flame burners or electrically heated oxidisers. Radiant burners are well known in the art, such as that described in EP 0 694 735.

Embodiments provide a burner inlet assembly having an inlet nozzle having a non-uniform bore extending from its inlet aperture which couples with an inlet conduit which provides the effluent gas stream to an outlet aperture which provides the effluent gas stream to the combustion chamber of the burner. In particular, the configuration of the nozzle bore changes from an inlet aperture which can couple with the inlet conduit and which provides the effluent gas stream to a non-circular outlet aperture. The non-circular outlet aperture provides a non-circular effluent gas stream flow into the combustion chamber. The non-circular effluent gas flow enables a greater volume of effluent gas stream to be introduced into the combustion chamber while still achieving or exceeding the required levels of abatement. This is because a non-circular effluent gas stream provides a reduced distance along which diffusion and reaction needs to occur compared to that of an equivalent circular effluent gas stream. Hence, an increased volume of effluent gas stream can be abated, compared to that of an equivalent circular effluent gas stream.

The performance of the abatement is further improved in embodiments by providing a baffle or restriction within the inlet nozzle between the inlet aperture and the outlet aperture. This baffle uses a baffle aperture to perform the restriction, which has a shape generally matching that of the outlet aperture and which is slightly smaller in cross-sectional area. This provides a sharp discontinuity downstream from the baffle which causes an expansion of flow to occur within the outlet portion extending from the baffle to the non-circular outlet aperture.

A secondary gas is introduced which assists in abatement. The secondary gas may be any suitable gas such as oxygen, water or other chemicals. The shape of the inlet nozzle does not lend itself to the use of a central lance or co-axial nozzle. However, the inlet nozzle has two shoulders adjacent the baffle aperture and as the effluent gas stream expands through the baffle aperture vortices are generated. The vortices may be used to improve the dispersion of the secondary gas stream within the effluent gas stream as it flows to the combustion chamber. Introducing the secondary gas stream in a way that maintains the stability of these vortices provides for reliable, predictable and consistent mixing of the secondary gas stream with the effluent gas stream and improves abatement.

The performance can be further improved in embodiments by providing the baffle with a shutter mechanism, which operates to change the area of the baffle aperture under different circumstances.

Head Assembly

Figure 2:
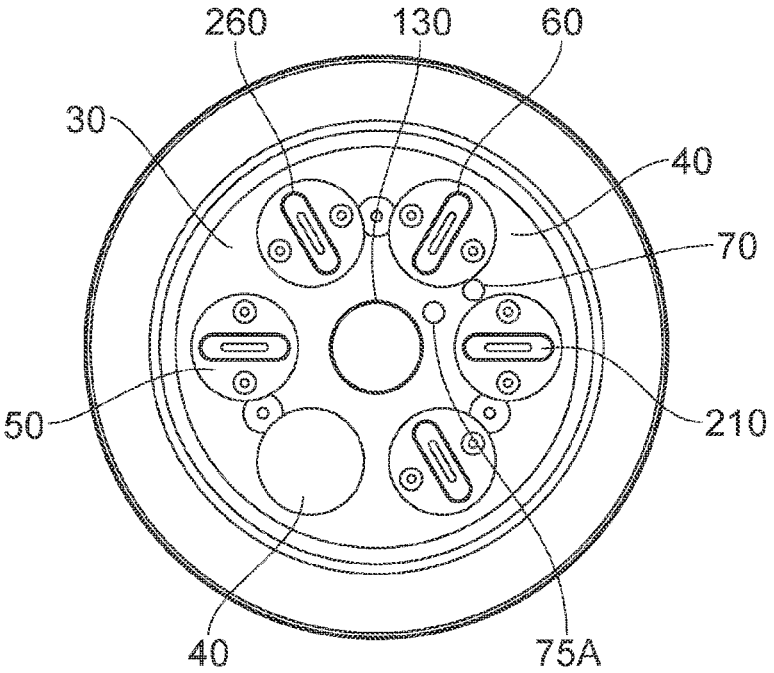
FIG. 2 is an underside plan view of the head assembly and burner of FIG. 1.

FIGS. 1 and 2 illustrate a head assembly, generally 10, according to one embodiment coupled with a radiant burner assembly 100. In this example, the radiant burner assembly 100 is a concentric burner having an inner burner 130 and an outer burner 110. A mixture of fuel and oxidant is supplied via a plenum (not shown) within a plenum housing 120 to the outer burner 110 and a conduit (not shown) to the inner burner 130.

The head assembly 10 comprises three main sets of components. The first is a metallic (typically stainless steel) housing 20, which provides the necessary mechanical strength and configuration for coupling with the radiant burner assembly 100. The second is an insulator 30 which is provided within the housing 20 and which helps to reduce heat loss from within a combustion chamber defined between the inner burner 130 and the outer burner 110 of the radiant burner assembly 100, as well as to protect the housing 20 and items coupled thereto from the heat generated within the combustion chamber. The third are inlet assemblies 50 which are received by a series of identical, standardized apertures 40 (see FIG. 2) provided in the housing 20. This arrangement enables individual inlet assemblies 50 to be removed for maintenance, without needing to remove or dissemble the complete head assembly 10 from the remainder of the radiant burner assembly 100.

The embodiment shown in FIG. 1 utilises five identical inlet assemblies 50, each mounted within a corresponding aperture 40, the sixth aperture is shown vacant. It will be appreciated that not every aperture 40 may be filled with an inlet assembly 50 which receives an effluent or process fluid, or other fluid, and may instead receive a blanking inlet assembly to completely fill the aperture 40, or may instead receive an instrumentation inlet assembly housing sensors in order to monitor the conditions within the radiant burner. Also, it will be appreciated that greater or fewer than six apertures 40 may be provided, that these need not be located circumferentially around the housing, and that they need not be located symmetrically either.

As can also be seen in FIGS. 1 and 2, additional apertures are provided in the housing 20 in order to provide for other items such as, for example, a sight glass 70 and a pilot 75A.

The inlet assemblies 50 are provided with an insulator 60 to protect the structure of the inlet assemblies 50 from the combustion chamber. The inlet assemblies 50 are retained using suitable fixings such as, for example, bolts (not shown) which are removed in order to facilitate their removal and these are also protected with an insulator (not shown). The inlet assemblies 50 have an outlet aperture 260 and a baffle portion 210 as will be explained in more detail below.

Inlet Assembly

Figure 3:
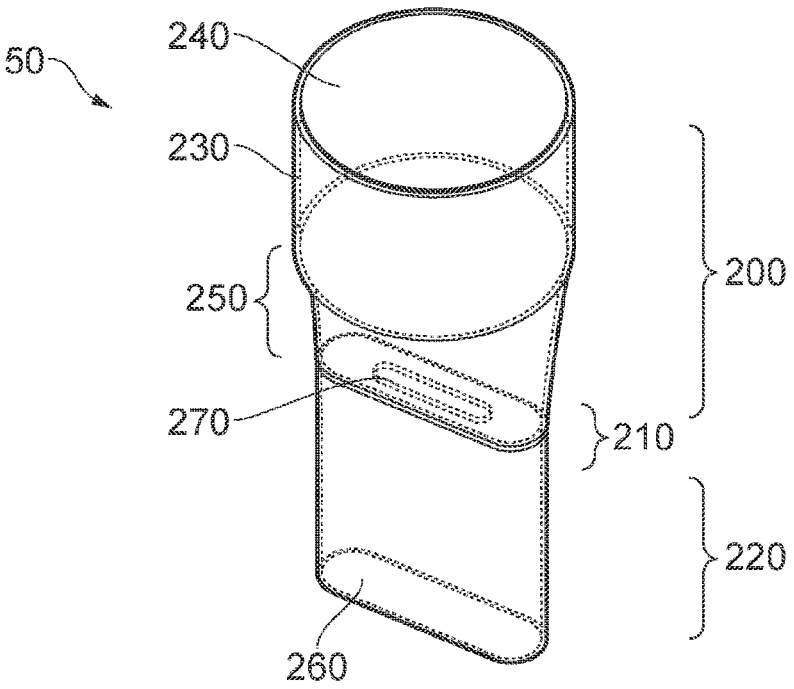
FIG. 3 shows the inlet assembly according to one embodiment.
Figure 4:
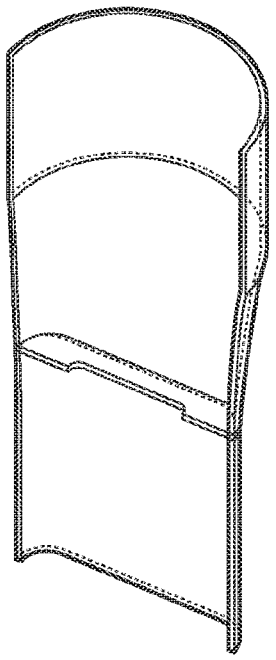
FIG. 4 shows a cross-section through the inlet assembly of FIG. 3.

FIG. 3 shows the inlet assembly 50, according to one embodiment. FIG. 4 shows a cross-section through the inlet assembly 50. The inlet assembly 50 forms a conduit for the delivery of the effluent gas stream provided by an inlet conduit (not shown) which delivers the effluent gas stream to the inlet assembly and to the combustion chamber. The inlet assembly 50 receives the effluent stream which is shaped by the inlet conduit and reshapes the effluent stream for delivery to the combustion chamber.

The inlet assembly 50 has three main portions which are an inlet portion 200, a baffle portion 210 and an outlet portion 220. It will be appreciated that an insulating shroud (not shown) may be provided on the outer surface of at least the outlet portion 220 which fits with the aperture 40A.

Inlet Portion

The inlet portion 200 comprises a cylindrical section 230 which defines an inlet aperture 240. It will be appreciated that the inlet portion 200 may be any shape which matches that of the inlet conduit. The cylindrical portion 230 couples with the inlet conduit to receive the effluent gas stream, which flows towards the baffle portion 210. In this embodiment, the inlet portion 200 is fed from a 50 mm internal diameter inlet pipe. Downstream from the cylindrical portion 230, the inlet portion transitions from a circular cross-section to a non-circular cross-section, which matches that of the outlet portion 220. Accordingly, there is a lofted transition portion 250 where the cross-sectional shape of the inlet portion 200 transitions from circular to non-circular. In this example, the cross-sectional shape changes from a circle to an obround. However, it will be appreciated that other transitions are possible. The provision of the matching cylindrical portion 230 and the lofted portion 250 upstream of the baffle portion 210 helps to prevent the build-up of deposits.

Outlet Portion

The outlet portion 220 maintains the same obround cross-sectional shape and area along its axial length and defines an outlet aperture 260 which provides the effluent stream to the combustion chamber. In this embodiment, the outlet portion is of obround cross-section of 8 mm internal radius on 50 mm centres, and is 75 mm long. Although in this embodiment the outlet portion 220 has a constant shape along its axial length, it will be appreciated that this portion may be tapered.

Baffle Portion

Located between the inlet portion 200 and the outlet portion 220 is a baffle portion 210. In this example, the baffle portion 210 comprises a plate having a baffle aperture 270. The baffle portion 210 is orientated orthogonal to the direction of flow of the effluent stream and provides a restriction to that flow. In this example, the shape of the baffle aperture 270 matches that of the cross-section of the outlet portion 220 and is symmetrically located within the baffle portion 210. The baffle aperture 270 has a smaller cross-sectional area than that of the outlet portion 220. In this embodiment, the baffle aperture is of 3 mm radius on 40 mm centres. This gives a slot velocity and nominal nozzle velocity of 24 m/s and 5 m/s respectively, at 300 litres per minute, compared to 4 m/s for a conventional 16 mm internal diameter nozzle at 50 litres per minute and 5 m/s at 60 litres per minute.

Accordingly, as can be seen, the internal volume of the cylindrical section 230 provides a continuous extension of the inlet conduit, whilst the lofted portion 250 transitions the shape of the conduit from circular to non-circular. This provides for near-laminar flow of the effluent stream until it reaches the baffle portion 210. The presence of the baffle portion 210 and its aperture 270 provides for a sharp discontinuity so that the effluent stream passing through the baffle aperture 270 undergoes an expansion of flow within the outlet portion 220. Although the presence of the baffle portion 210 is not required, as will be discussed below, including a baffle portion 210 improves the subsequent abatement performance.

Non-Circular Outlet

Figure 5:
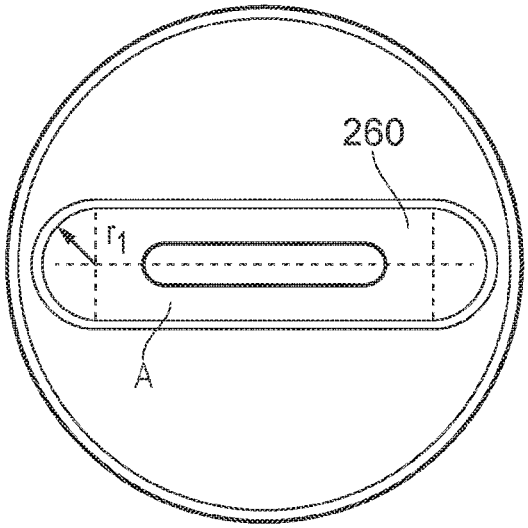
FIG. 5 shows the outlet aperture when viewed along the axial length of the inlet assembly.
Figure 5:
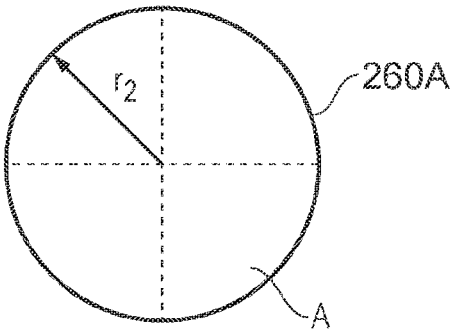

FIG. 5 shows the outlet aperture 260 when viewed along the axial length of the inlet assembly 50. The outlet aperture 260 has an area A. FIG. 5 also illustrates a circular outlet aperture 260*a* having an area A equivalent to that of the outlet aperture 260.

As can be seen, in order to provide an equivalent area, the diffusion length $r_2$ for the circular outlet aperture 260*a* is significantly longer than the diffusion length $r_1$ of the outlet aperture 260.

Therefore, for the same flow rate, the time taken for diffusion and abatement to occur on an effluent stream provided by the circular outlet aperture 260A is considerably longer than that for the effluent stream provided by the outlet aperture 260. In other words, the length of the combustion chamber needed to perform the abatement reaction for the same flow rate effluent stream provided by the circular outlet aperture 260A would need to be considerably longer than that provided by the outlet aperture 260. In other words, a more compact radiant burner is possible using the outlet aperture 260 than is possible with the circular outlet aperture 260A.

Baffle Portion—Alternative Embodiments

Figure 6:
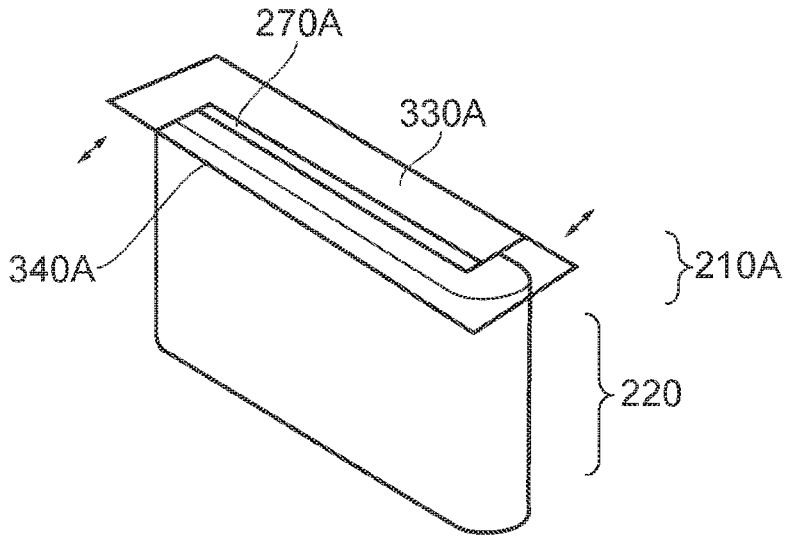
FIGS. 6 and 7 show baffle portions according to embodiments.
Figure 7:
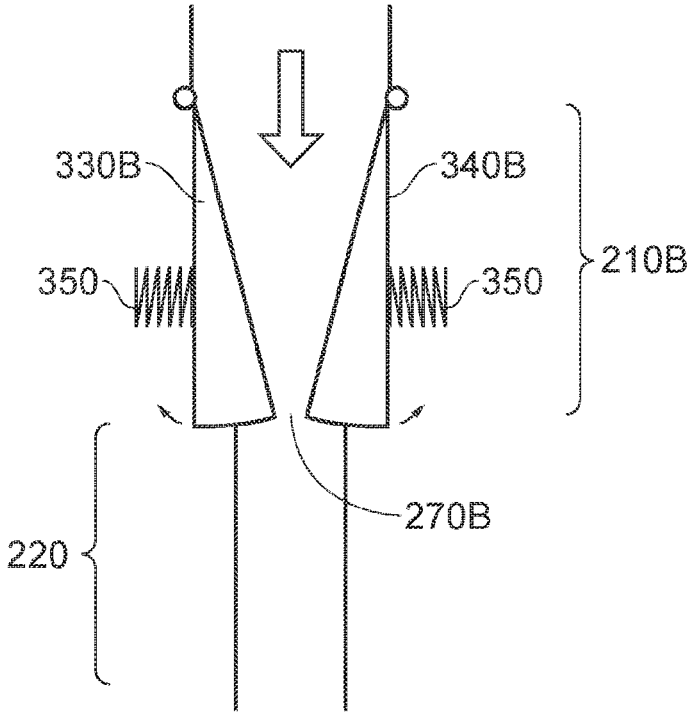

FIGS. 6 and 7 illustrate alternative arrangements for the baffle portion.

FIG. 6 shows a baffle portion 210A having shutter arrangement comprised of a pair of slidably-mounted plates 330A, 340A, which together define a variable size baffle aperture 270A. In this example, the plates 30A, 240A are L-shaped. However, it will be appreciated that other shutter structures and shapes are conceivable. The plates 330A, 340A may be moved together or apart in order to change the area of the baffle aperture 270A.

FIG. 7 shows a parallel sided slot nozzle arrangement utilizing a pair of pivoting plates 330B, 340B which are biased by springs 350 to restrict the size of the baffle aperture 270B. The pivoting plates 230B, 240B are acted upon by the flow of the effluent gas stream, which increases the area of the baffle aperture 270B. It will be appreciated that other biased shutter mechanisms may be provided.

Typically, the dimensions of the baffle aperture can be changed in two ways: manually, in response to the low flow rate of gas through the nozzle, such that the throat dimensions are optimized to suit the throughput of the process gas plus pump dilution. For example, when abating a gas such as $NF_3$, a more constricted throat gives improved abatement performance, but this same throat size leads to increased deposition of solids on the burner surface when abating a particle forming gas such as $SiH_4$, in which case a less constricted throat is advantageous. Also, the throat dimensions may be optimized automatically, so that the throat of the baffle portion is deformable against a spring action or other restoring force. It will be appreciated that the use of the two opposing plates 330A, 340A are easier to adjust than adjusting the area of an equivalent circular aperture.

Performance Results

Figure 8A:
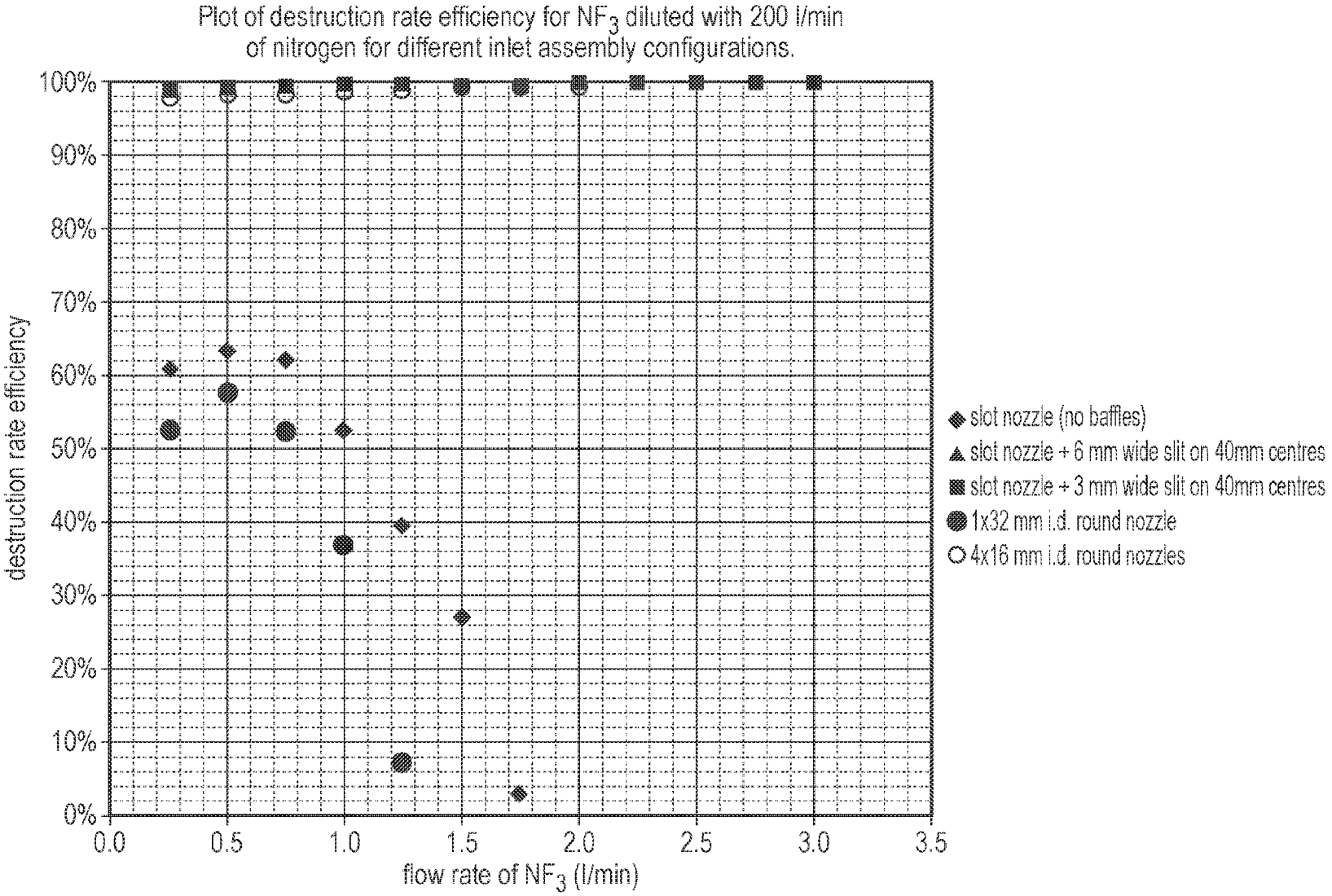
FIG. 8A is a graph showing a plot of destruction rate efficiency for $NF_3$ diluted with 200 l/min of nitrogen for different inlet assembly configurations.
Figure 8B:
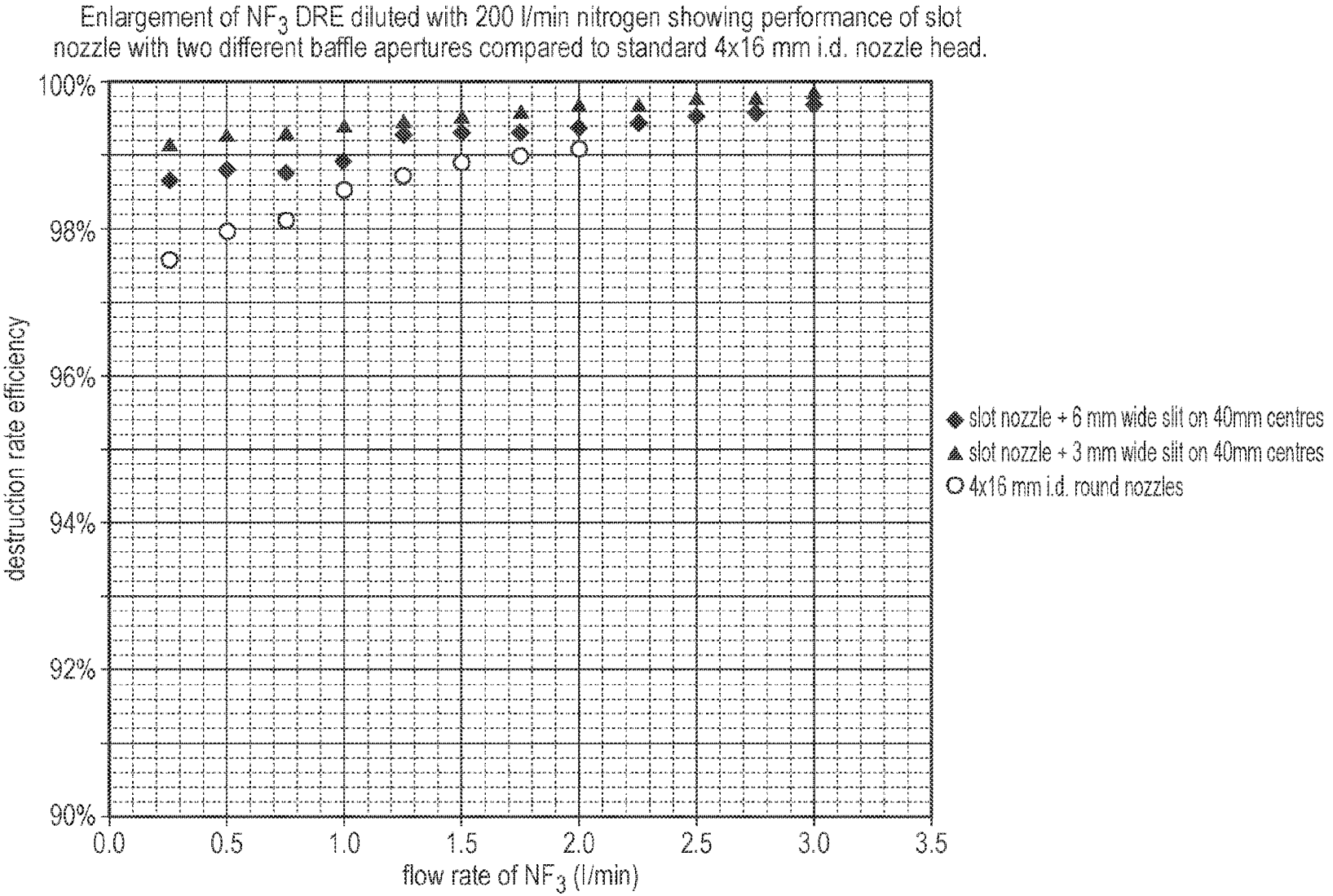
FIG. 8B is an enlargement of FIG. 8A showing a plot of $NF_3$ destruction rate efficiency diluted with 200 l/min nitrogen and showing the performance of a head assembly having a single inlet assembly of embodiments (with two different baffle apertures) compared to an existing head assembly having four 16 mm internal diameter circular inlet assemblies.
Figure 8C:
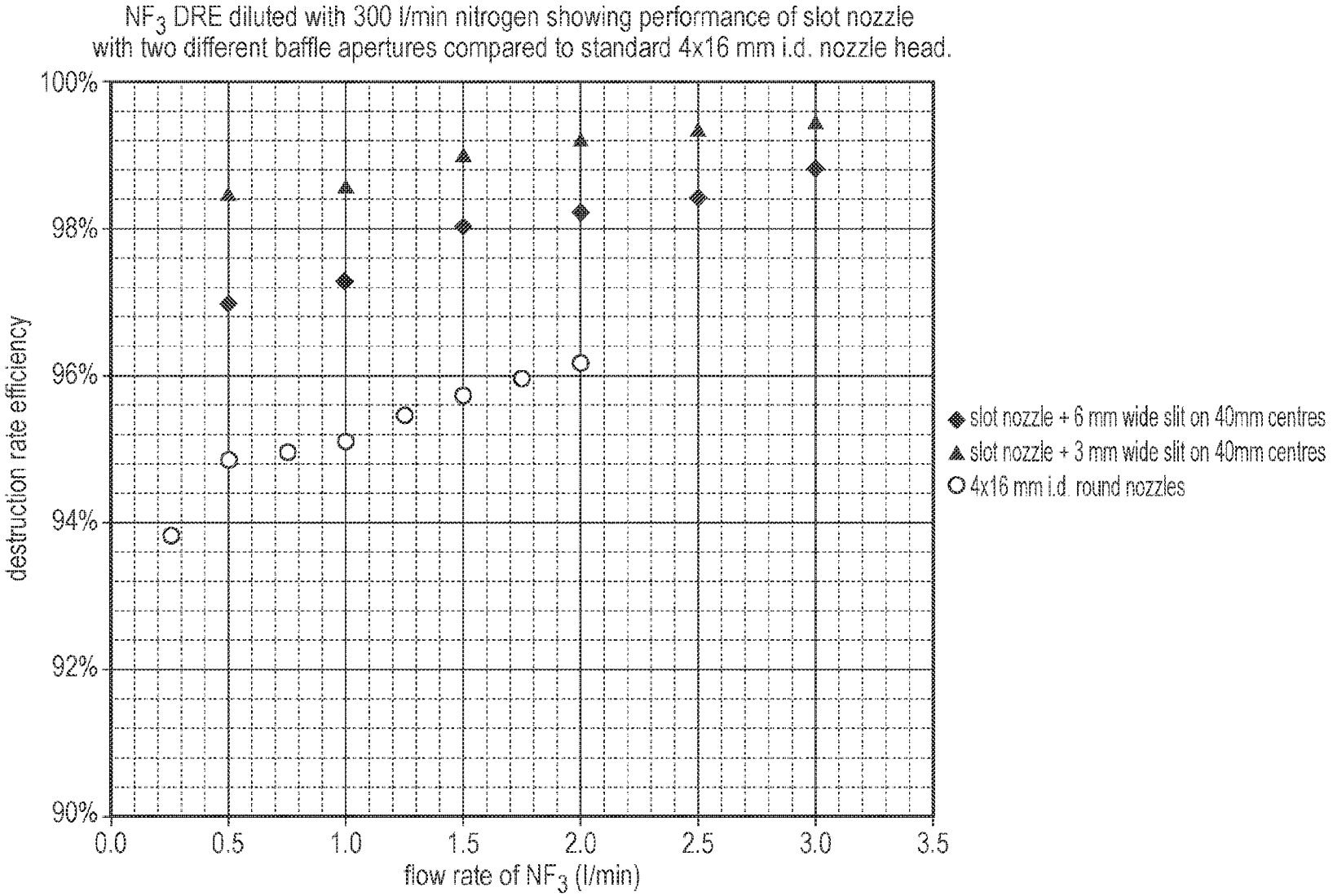
FIG. 8C is a graph showing a plot of destruction rate efficiency for $NF_3$ diluted with 300 l/min nitrogen showing the performance of a head assembly having a single inlet assembly of embodiments (with two different baffle apertures) compared to an existing head assembly having four 16 mm internal diameter circular inlet assemblies.

As can be seen in FIGS. 8A to 8C, the performance of a radiant burner using the inlet assembly of embodiments is improved compared to that of existing arrangements.

FIG. 8A shows a plot of the destruction rate efficiency for $NF_3$ which was measured as part of a simulated effluent stream with 200 l/min of nitrogen for different inlet assembly configurations feeding a 152.4 mm (6 inch) internal diameter by 304.8 mm (12 inch) axial length radiant burner operating with 36 standard litres per minute (SLM) of fuel which provides a residual oxygen concentration of 9.5%, when measured in the absence of the effluent gas stream. As can be seen, using the inlet assembly of embodiments provides for significant performance improvement over an existing arrangement using a single 32 mm internal diameter circular inlet assembly. Also, those inlet assemblies of embodiments which have baffle portions provide for significant performance improvement over an existing arrangement using four 16 mm internal diameter circular inlet assemblies, as can be seen in more detail in FIG. 8B.

FIG. 8B is an enlargement of FIG. 8A when operating under the same conditions as a standard head assembly having 4×16 mm internal diameter nozzles. The inlet assembly 50 (referred to as "slot nozzle" having different baffle aperture arrangements) slightly outperforms the standard head assembly under this dilution of nitrogen.

FIG. 8C shows the same arrangement as FIG. 8B, but with the total flow of nitrogen which dilutes the $NF_3$ having been increased to 300 SLM. As can be seen, the inlet assembly 50 ("slot nozzle" having different baffle aperture arrangements) has much improved performance compared to that of the standard head assembly under this increased fluid flow.

Providing a changeable size baffle aperture helps to further improve the performance of the burner assembly under different operating conditions. For example, for 100 SLM of nitrogen, $NF_3$ abatement is superior with a larger baffle aperture (for example, 6 mm wide), whereas for higher flow rates (for example, 200 and 300 SLM) of nitrogen, the narrower slot performs better. Furthermore, the size of the baffle aperture or orifice may be changed to not generate or to relieve a high backpressure during flow transients such as chamber pump-down when there is no process gas to be abated.

Hence, it can be seen that embodiments provide an inlet assembly to a combustive abatement system which comprises a single nozzle constructed in the form of a slot or obround, in flow communication with an inlet pipe upstream and a combustion chamber downstream. The interface between the inlet pipe and nozzle provides for a sharp discontinuity on the downstream side, such that an expansion of flow occurs within the nozzle. This arrangement is demonstrated to give enhanced destruction of the effluent stream or process gas containing, for example, $NF_3$, over existing configurations. Indeed, the performance of a single nozzle with this configuration exceeds that of a plurality of separate nozzles used in existing burner assemblies.

Secondary Gas Stream

Figure 9:
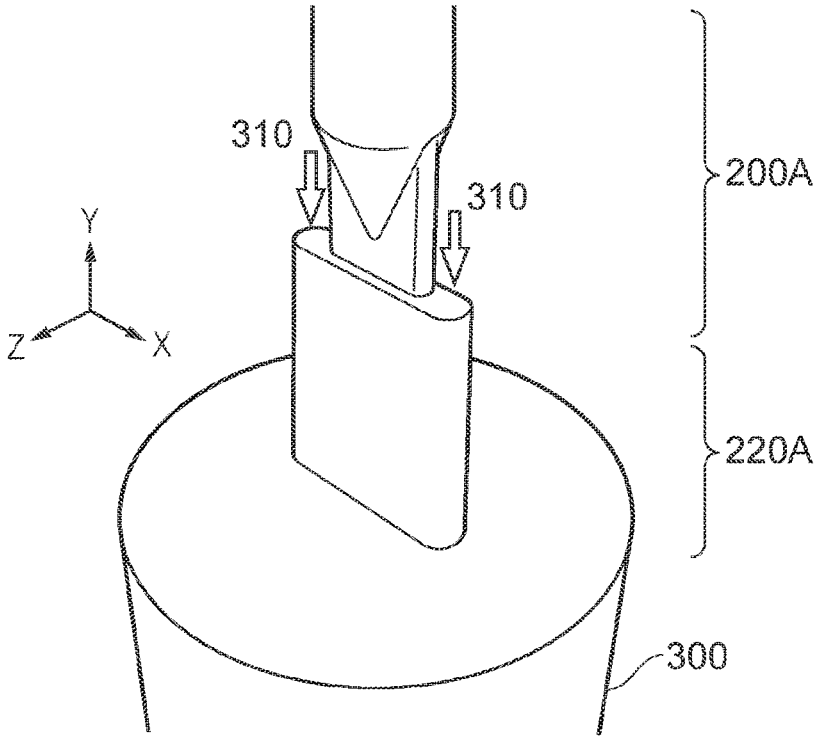
FIG. 9 shows the gas volume of an inlet assembly according to one embodiment.

As mentioned above, a secondary gas stream may be introduced in order to further improve abatement. FIG. 9 illustrates the gas volume defined by an inlet nozzle (not shown to improve clarity) according to one embodiment discharging into a combustion chamber (also not shown to improve clarity). The inlet nozzle which defines this gas volume is similar to that illustrated in FIGS. 1 to 7 (and in particular as shown in FIGS. 3 and 4), but the lofted transition portion 250 transitions from circular to non-circular, from the inlet aperture directly to the baffle aperture 270. In other words, the inlet portion 200 transitions from the cylindrical section 230 directly to the baffle aperture 270, rather than transitioning to the outer edge of the baffle portion 210. This means that there is no plate intersecting the flow of the effluent gas stream, but the expansion caused by the discontinuity of the baffle aperture 270 and the expansion of flow that undergoes downstream of the baffle aperture 270 still occurs. In this embodiment, a single inlet assembly is provided which exhausts into the combustion chamber 300, but it will be appreciated that more than one inlet assembly may be provided, as shown in FIGS. 1 and 2. As can also be seen in FIG. 9, two shoulder regions 310 of the gas volume near to the baffle aperture are suitable locations for providing the secondary gas stream as will now be explained.

Figure 10:
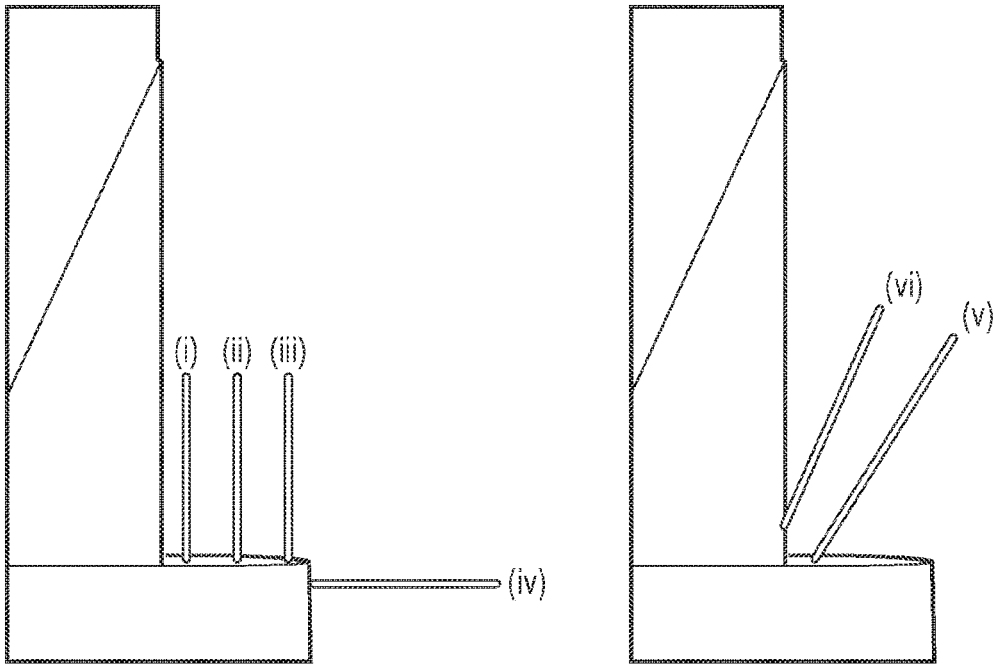
FIG. 10 shows locations of secondary gas stream nozzles according to embodiments.
Figure 23:
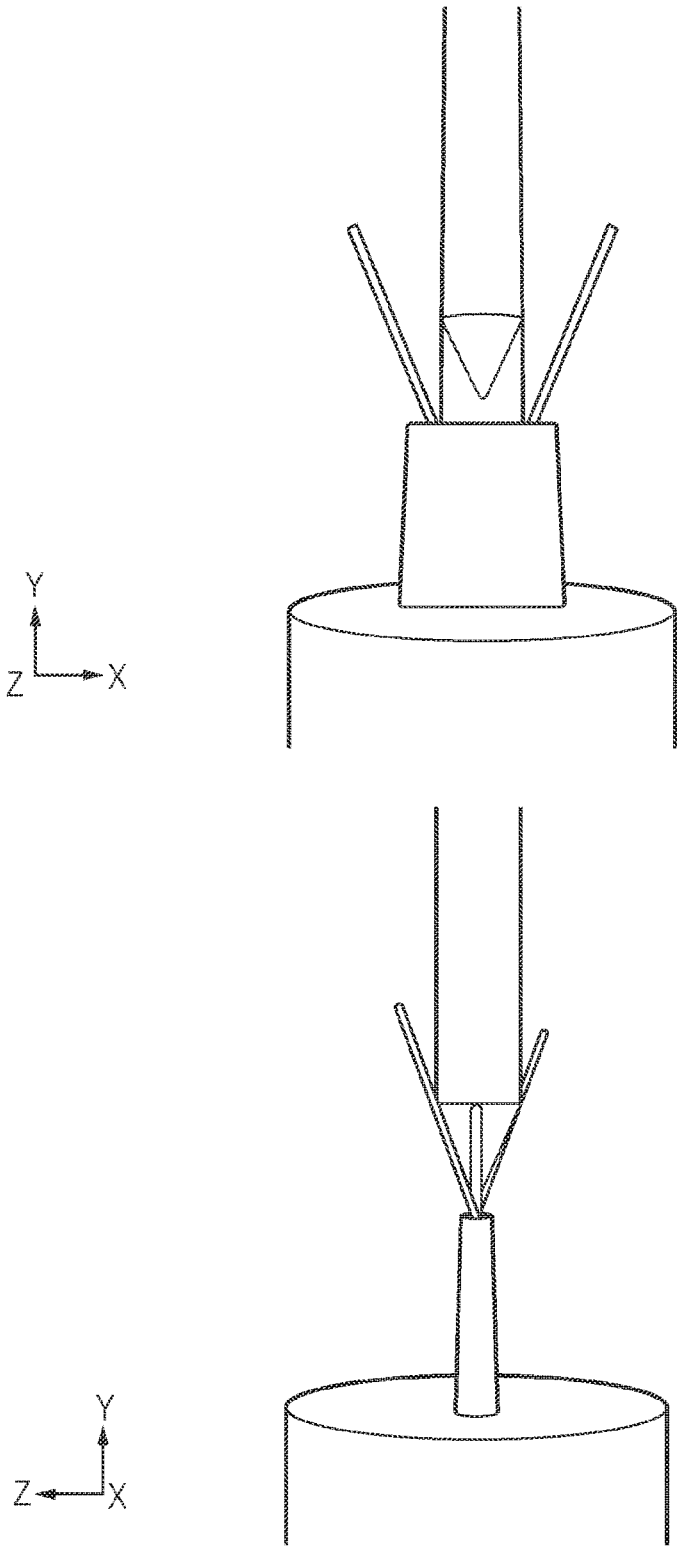
FIG. 23 shows a location of secondary gas stream nozzles according to one embodiment.

FIG. 10 shows six locations for introducing the secondary gas stream which will be discussed with reference to simulation results below. For each location, one lance was placed on each shoulder 310 and had an internal diameter of 0.004 metres. The lance inlet point was generally placed centrally on the Z axis (see FIG. 9) and was moved only in the X direction to adjust the geometry. In one embodiment, as shown in FIG. 23, the lance inlet point was placed centrally placed on the Z axis (see FIG. 9) and was moved in both the X direction and Z direction to adjust the geometry.

Arrangement 1—Vertical into Shoulder

Three Positions were Attempted:

(i) tight to the baffle aperture;

(ii) centrally-located on the shoulder; and (iii) tight to the outside of the outlet portion nozzle bore.

Arrangement 2—Horizontal into Shoulder

One Position was Attempted:

(iv) horizontally, entering the top outside edge of the shoulder 310, entering the outlet portion of the nozzle bore radially.

Arrangement 3—Angled into Shoulder

One Position was Attempted:

(v) Lances were introduced into the shoulder 310 at the same location as (i) but were angled between 10° and 400 from the vertical (Y) axis, angling away from the baffle aperture, in the XY plane. In one embodiment, the lances were introduced into the shoulder 310 at the same location as (i) but were angled at 200 from both the vertical (Y) axis and the Z axis, angling away from the baffle aperture (see FIG. 23).

Arrangement 4—Angled into Baffle Aperture, Just Above Baffle Aperture

One Position was Attempted:

(vi) Lances were introduced at an angle of 10° from the vertical, angling away from the inlet portion in the XY plane, just upstream of the baffle aperture.

These arrangements were simulated using computational fluid dynamic (CFD) modelling, together with an arrangement with no secondary gas stream, as illustrated in FIGS. 11 to 21. The results show the mixing and flow profiles of the various inlet positions. The main process flow of the effluent gas stream in the main inlet portion (200A) was set to be a 1% $NF_3$ mixture in 300 SLM of nitrogen. The lances each had a flow of 33 SLM of oxygen.

The data is presented in two ways. First is an image showing the ratio of oxygen to $NF_3$. The ratio has been limited to the range 0 to 200, where 0 denotes that only $NF_3$ is present and 200 where only oxygen is present. Ideally, regions of low mixing will dissipate through the mixing effect in and near the outlet portion 220A. Long 'jets' of either only $NF_3$ or only oxygen are a sign of ineffective mixing. Second is an image which shows the flow pattern through the inlet assembly and into the combustion chamber. This shows whether the splitting effect of the flow, and thus the potential for good mixing with burner gas, is maintained.

Figure 11:
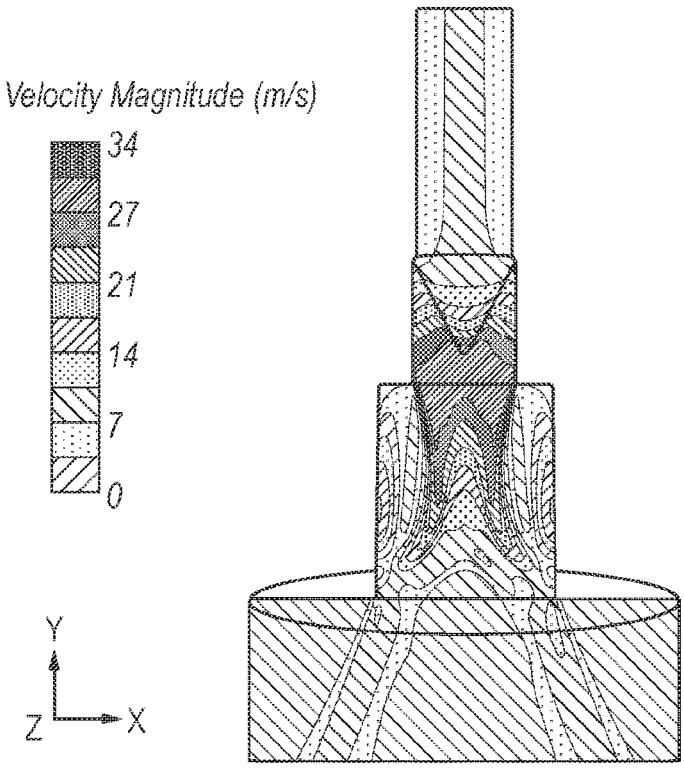
FIG. 11 show a flow pattern of an inlet assembly with no secondary gas stream nozzle.

FIG. 11 shows the flow pattern when there are no lance inlets and in particular the flow pattern generated by the expansion between the baffle portion and the outlet portion and how it propagates into the burner.

Figure 12A:
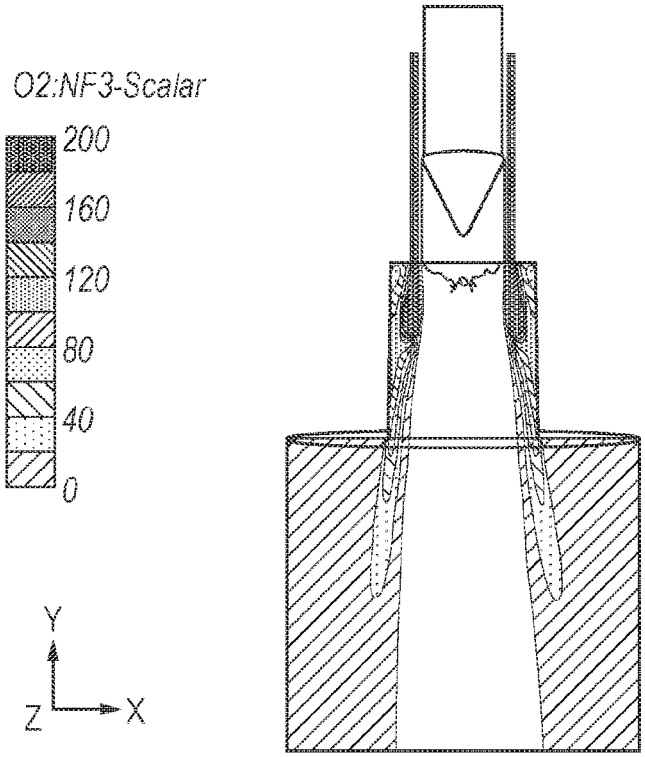
FIGS. 12 to 22 show flow patterns of inlet assemblies with secondary gas stream nozzles located at different positions according to embodiments.
Figure 12B:
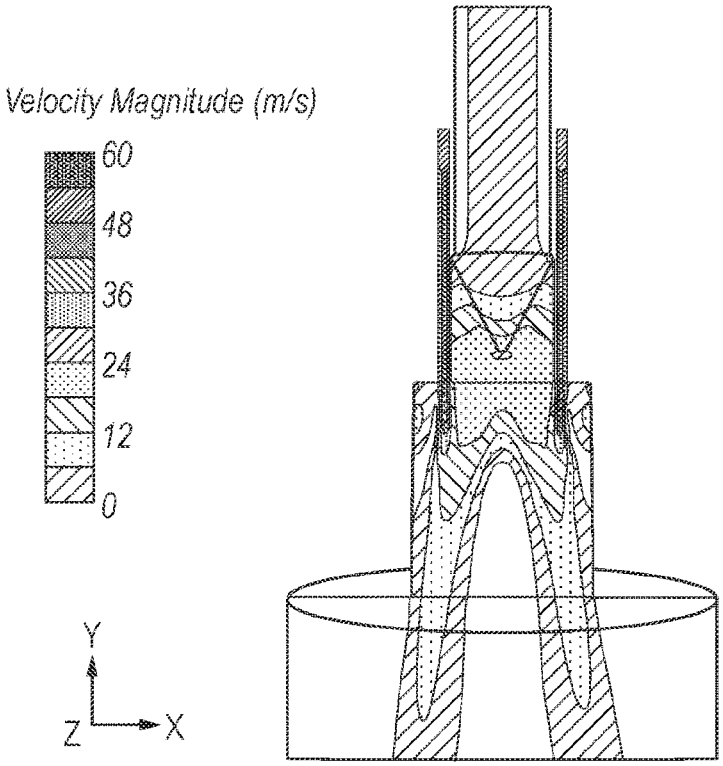
Figure 13A:
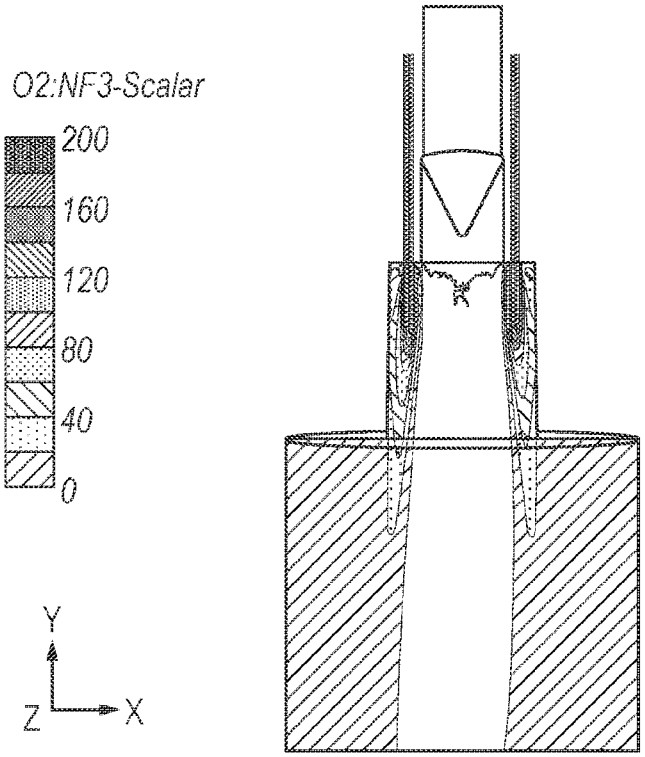
Figure 13B:
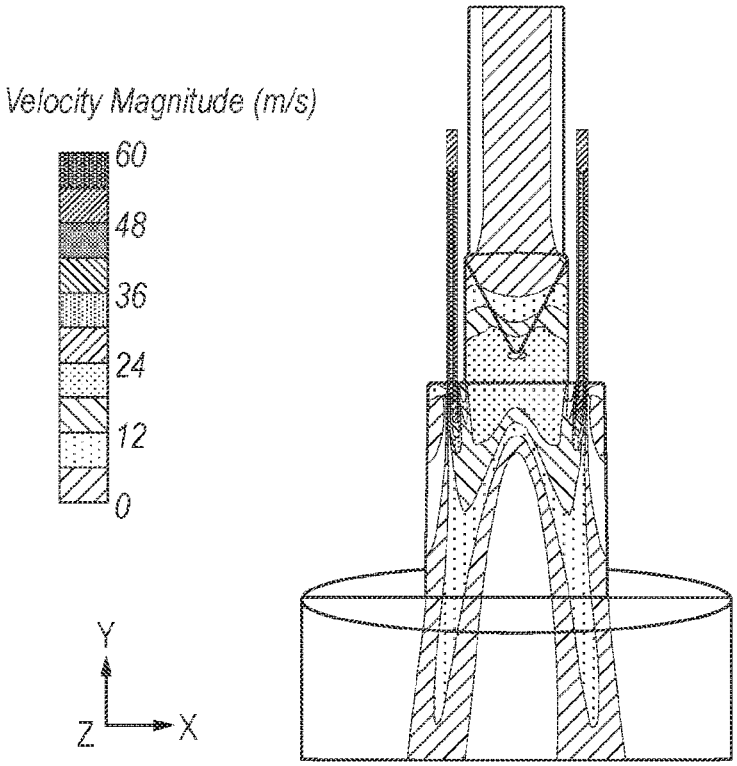
Figure 14A:
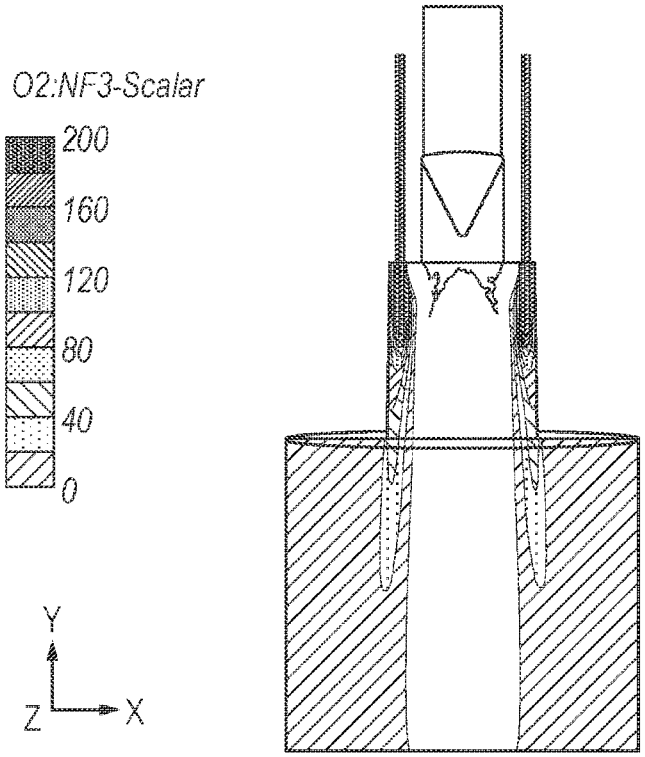
Figure 14B:
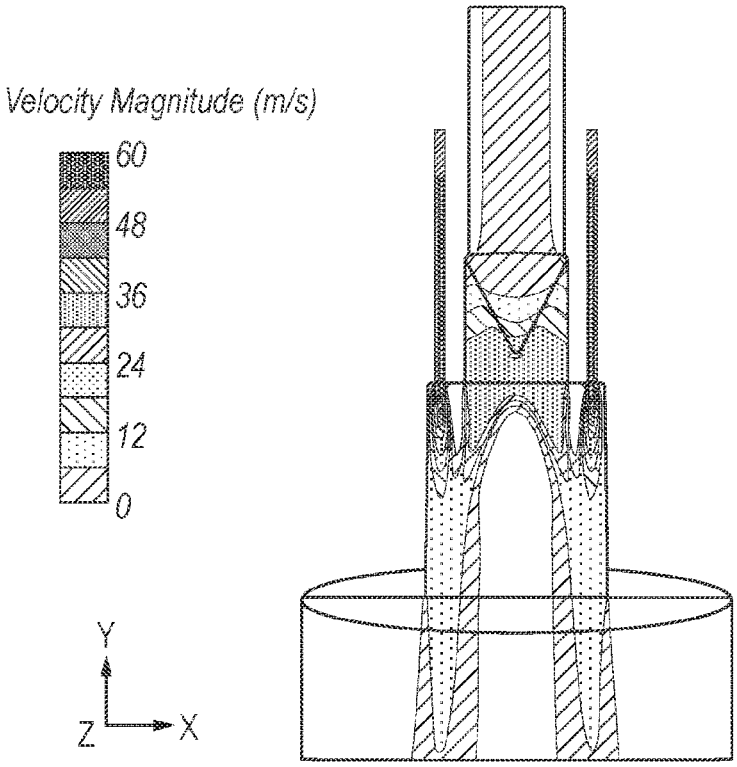

As can be seen in FIGS. 12 to 14, the vertical inlets, designated (i), (ii) and (iii) were all partially successful. FIG. 12 shows the ratio of oxygen to $NF_3$ (top) and the effective spread of gas below outlet portion (bottom) for inlet position (i).

FIG. 13 shows the ratio of oxygen to $NF_3$ (top) and the effective spread of gas below outlet portion (bottom) for inlet position (ii). FIG. 14 shows the ratio of oxygen to $NF_3$ (top) and the effective spread of gas below outlet portion (bottom) for inlet position (iii). The mixing of the oxygen and $NF_3$ occurs in all three set-ups. The spreading of the gas into the combustion chamber 300 downstream of the outlet portion 220A, generated by the vortices seen in the outlet portion 220A of the system in FIG. 11, are largely nullified by the introduction of the oxygen into the shoulders 310 of the outlet portion 220A.

The extent of the nullification increases from (i) to (ii) to (iii). This is perhaps unsurprising as whilst the oxygen is being introduced almost tangentially into the vortices in set-up (i), and with the direction of flow, in (iii) they are aimed at a portion of the vortices that are rotating back up towards the lance inlet point.

Figure 15A:
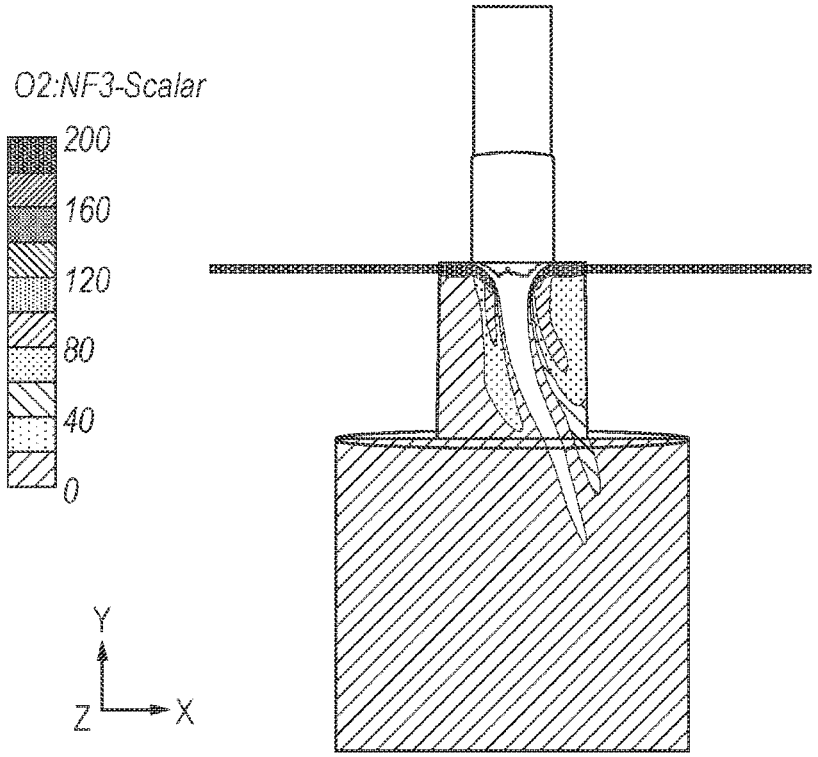
Figure 15B:
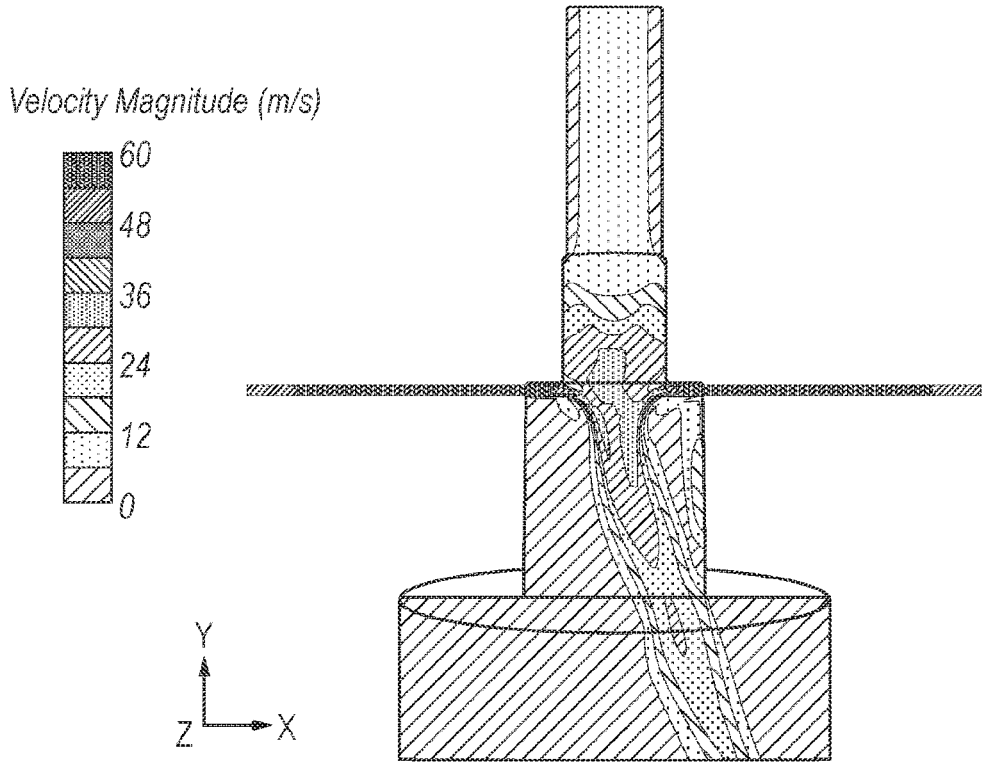

FIG. 15 shows the ratio of oxygen to $NF_3$ (top) and the effective spread of gas below outlet portion (bottom) for inlet position (iv). As can be seen in FIG. 15, position (iv) has much shorter oxygen 'jets' than the three preceding options (FIG. 15, top picture), suggesting better mixing with the $NF_3$, but the mixing of the gas into the combustion chamber 300 (FIG. 15, bottom picture) is significantly worse as the vortices are being disrupted completely and the splitting of the flow seen in the preceding options is not seen here. Additionally, due to the asymmetric flow out of the outlet portion 220A, gas from the combustion chamber 300 is being drawn up into the outlet portion 220A, which is undesirable.

Figure 16A:
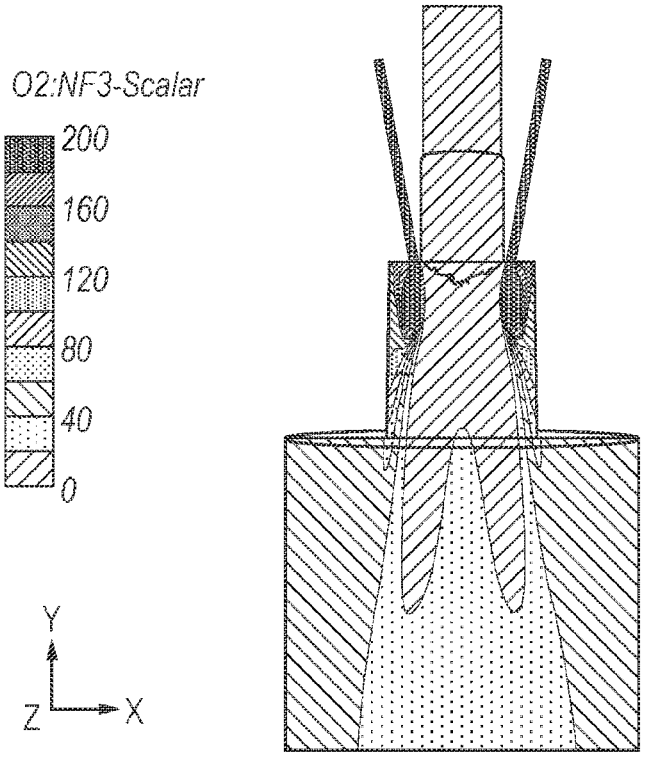
Figure 16B:
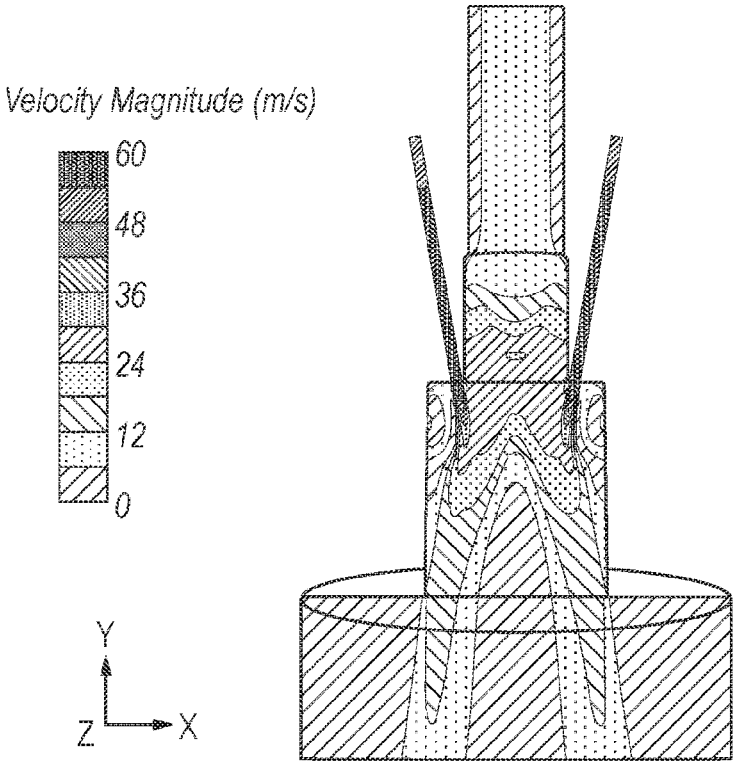
Figure 17A:
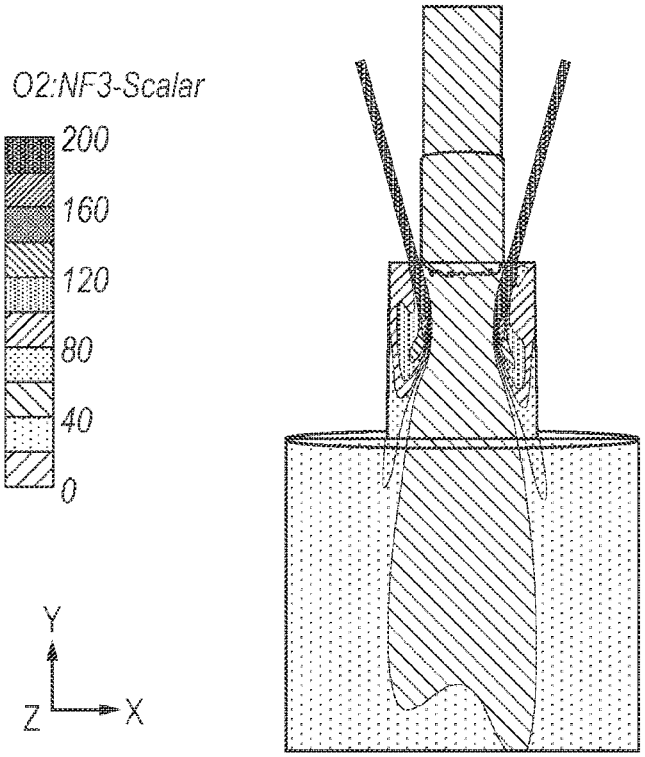
Figure 17B:
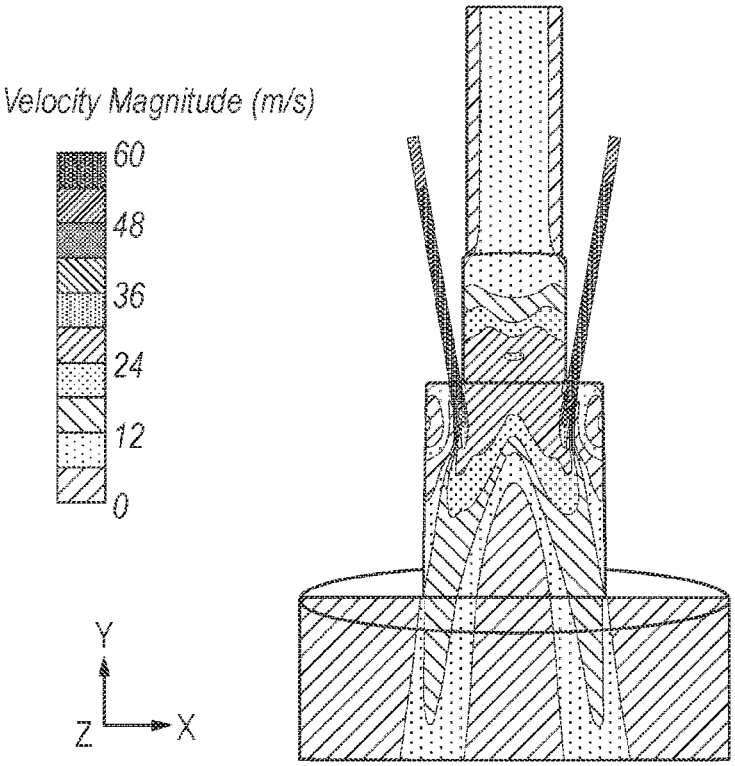
Figure 18A:
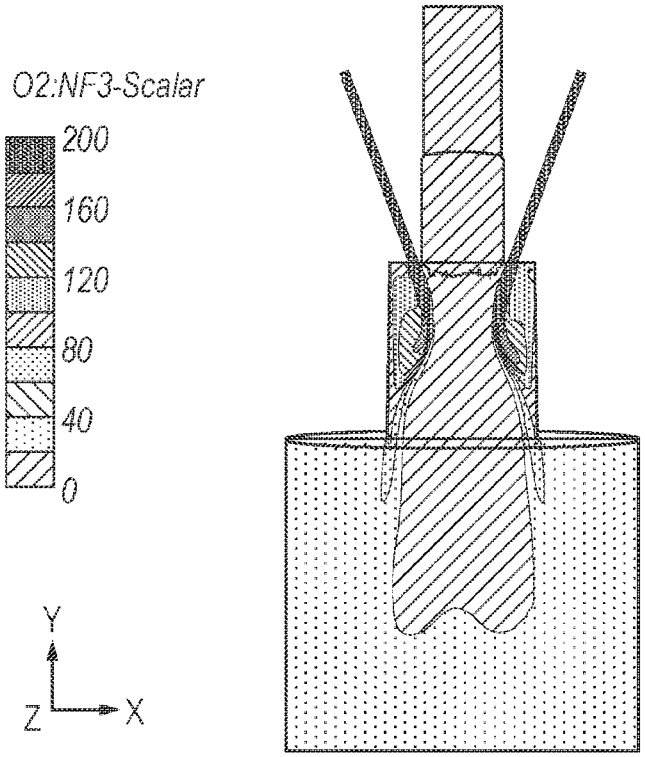
Figure 18B:
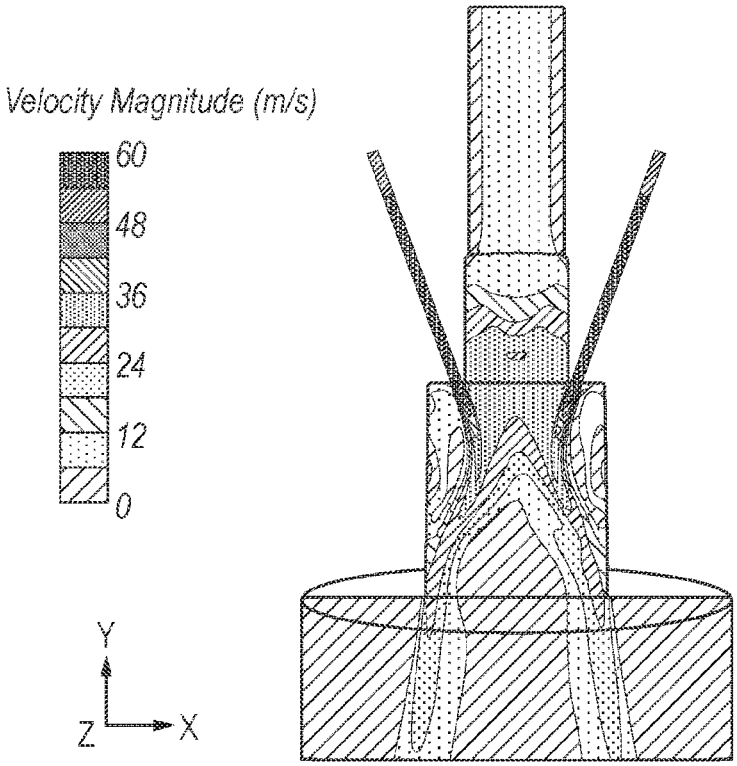
Figure 19A:
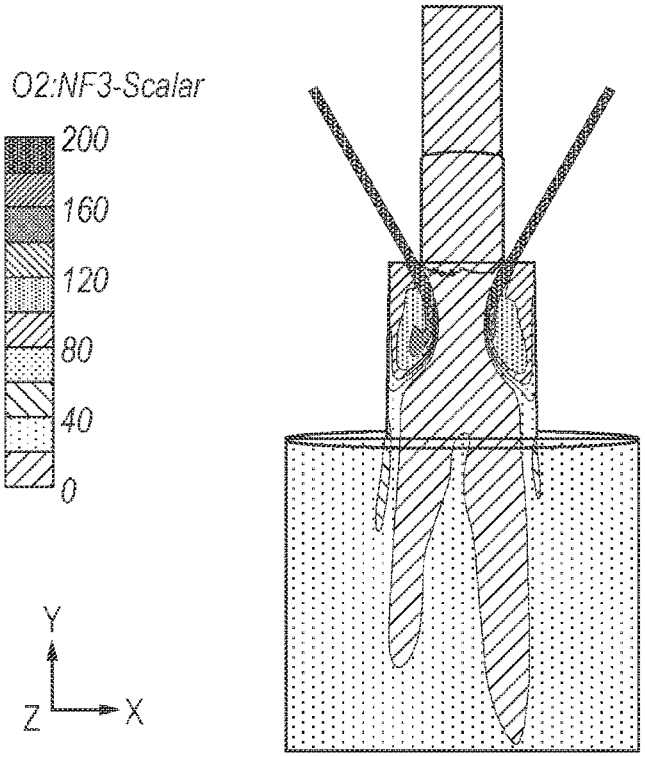
Figure 19B:
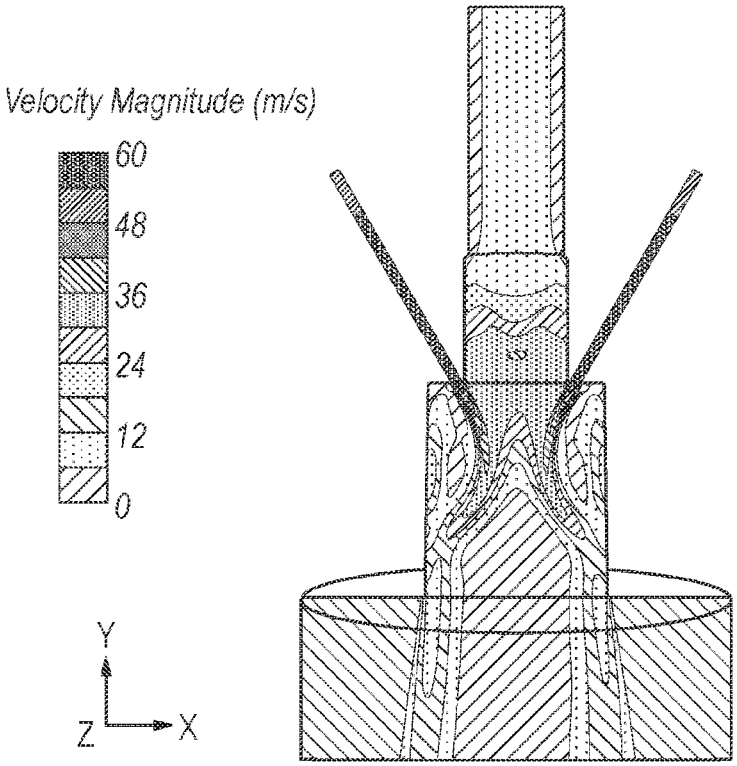

FIG. 16 shows the ratio of oxygen to $NF_3$ (top) and the effective spread of gas below outlet portion (bottom) for inlet position (v), set to 100 from the vertical (longitudinal) (Y) axis, angling away from the inlet portion in the XY plane. FIG. 17 shows the ratio of oxygen to $NF_3$ (top) and the effective spread of gas below outlet portion (bottom) for inlet position (v), set to 150 from the vertical (longitudinal) (Y) axis, angling away from the inlet portion in the XY plane. FIG. 18 shows the ratio of oxygen to $NF_3$ (top) and the effective spread of gas below outlet portion (bottom) for inlet position (v), set to 200 from the vertical (longitudinal) (Y) axis, angling away from the inlet portion in the XY plane. FIG. 19 shows the ratio of oxygen to $NF_3$ (top) and the effective spread of gas below outlet portion (bottom) for inlet position (v), set to 300 from the vertical (longitudinal) (Y) axis, angling away from the inlet portion in the XY plane.

As can be seen in FIGS. 16 to 19, the angled inlets, between 10° and 30°, all behave well, with a 'best' range between 15° and 30°. These all maintain the vortices to generate the split flow effect and have the oxygen 'jets' dissipating quickly due to the oxygen being fed tangentially into the vortices (FIGS. 8-11).

Figure 20A:
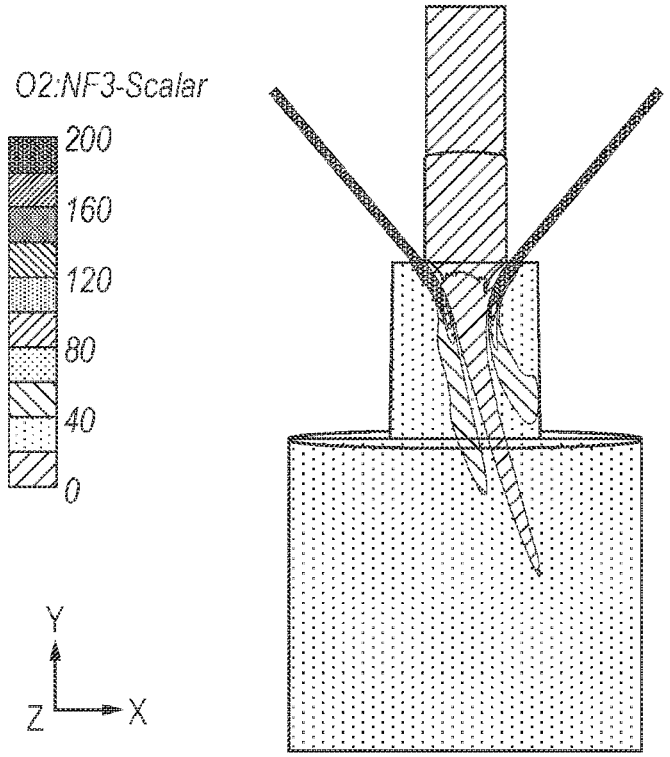
Figure 20B:
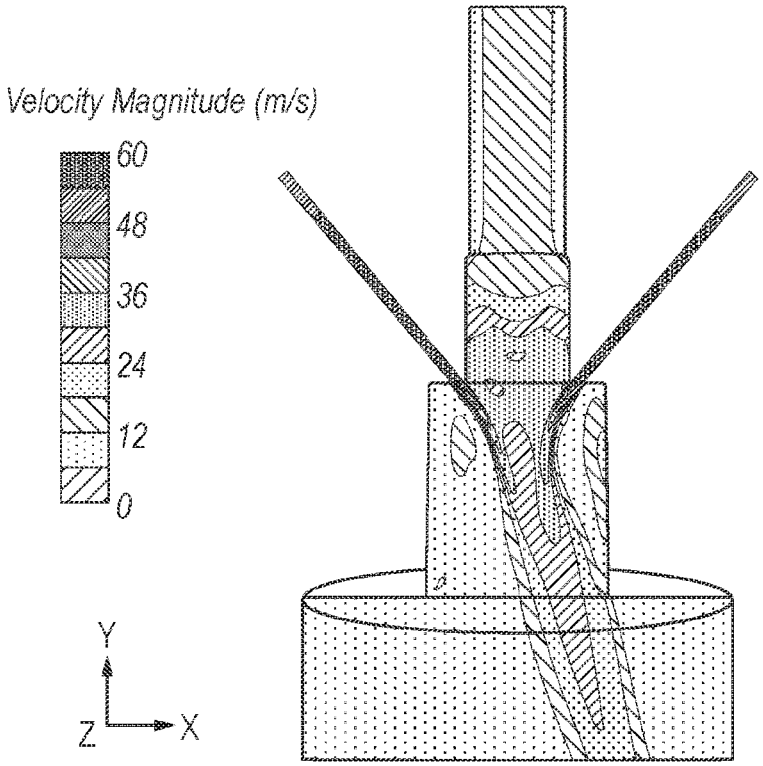

FIG. 20 shows the ratio of oxygen to $NF_3$ (top) and the effective spread of gas below outlet portion (bottom) for inlet position (v), set to 40° from the vertical (longitudinal) (Y) axis, angling away from the inlet portion in the XY plane. As can be seen in FIG. 20, at 400 the angle is becoming too great and the mixing effect is more akin to that seen by the fully horizontal inlets shown by position (iv) in FIG. 15.

Figure 22A:
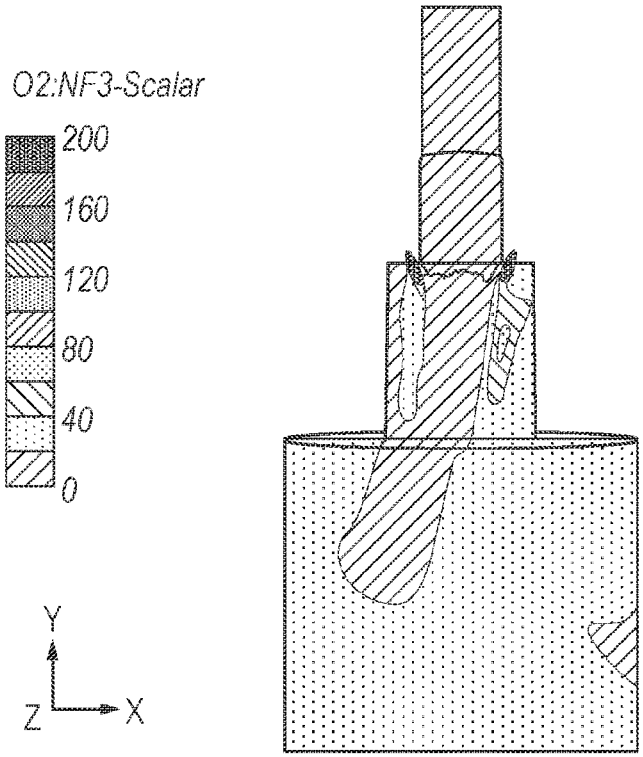
Figure 22B:
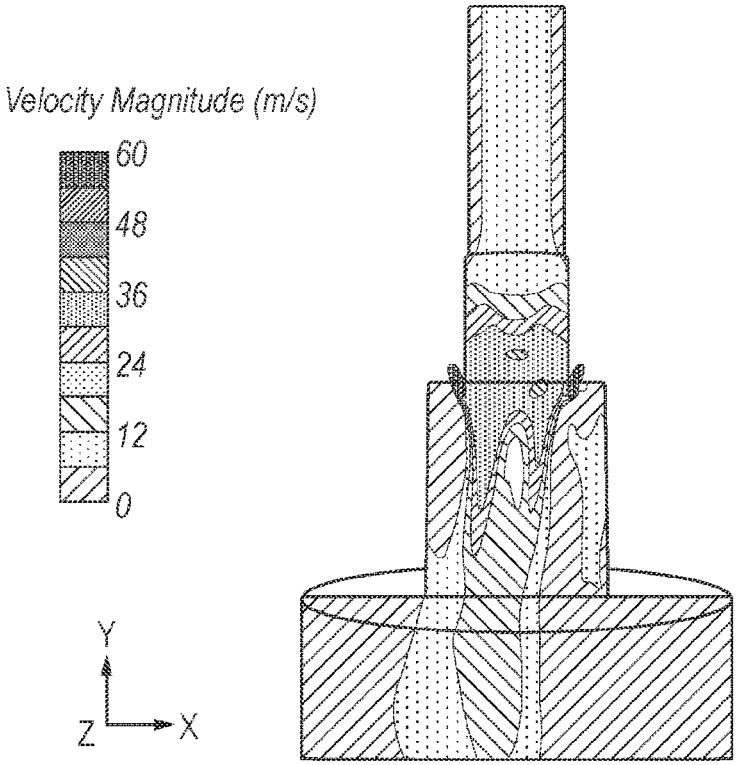

FIG. 22 shows the ratio of oxygen to $NF_3$ (top) and the effective spread of gas below outlet portion (bottom) for inlet position (v), set to 200 from the vertical (longitudinal) (Y) axis and the Z axis, angling away from the inlet portion. As can be seen in FIG. 22, this arrangement doesn't completely destroy the vortices, but it does disrupt them and so is less effective than arrangements which have the lances on the central (XY) plane.

Figure 21A:
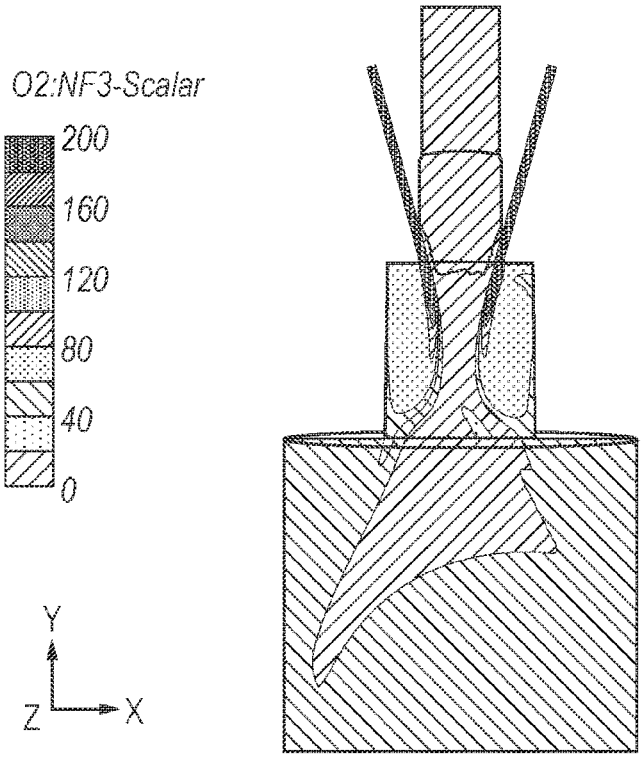
Figure 21B:
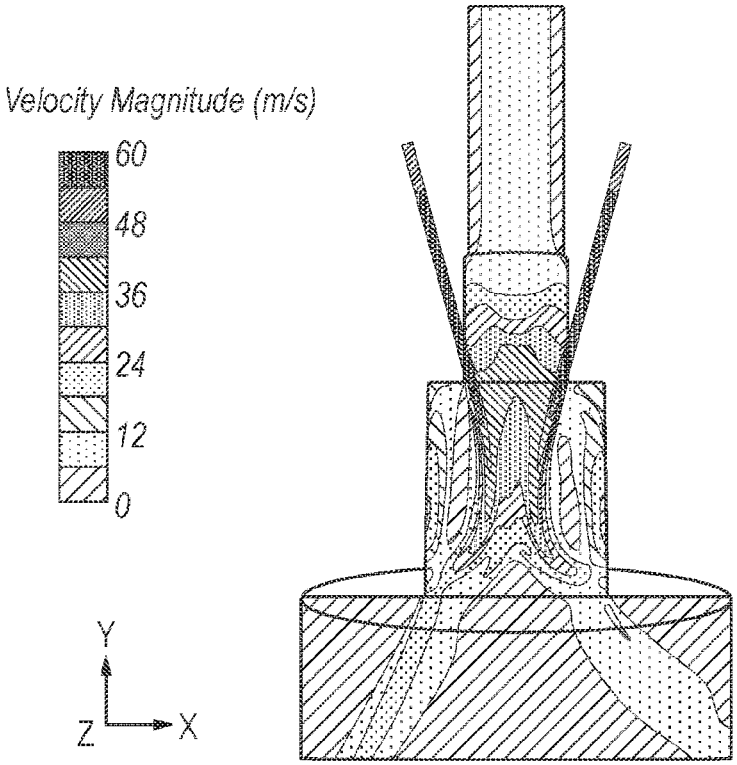

FIG. 21 shows the ratio of oxygen to $NF_3$ (top) and the effective spread of gas below outlet portion (bottom) for inlet position (vi). As can be seen in FIG. 21, the introduction of oxygen is via position (vi) and into the inlet portion 200A, just upstream of the baffle aperture. Whilst this can be seen to have not disrupted the vortices, the data is asymmetric which implies that the flow is unstable.

As can be seen in from FIG. 8A, the nozzle arrangements without lances show a range of destruction removal efficiencies (DRE) depending upon the configuration of the baffle portion. When compared to the CFD data, the baffle configurations which resulted in good DRE are those seen to produce the vortices in the outlet portion seen in FIG. 11. Therefore, it is desirable to maintain these vortices when introducing the additional oxygen or other secondary gas stream. The CFD mentioned above that angling the oxygen into the outlet portion so that it is flowing tangentially into the vortices, and in the same flow direction, produces good mixing of the oxygen with the $NF_3$ and also maintains the vortices that improve DRE.

Embodiments provide a slot nozzle with side lances. Embodiments recognise that to introduce secondary gases into a standard nozzle system, either a central lance or co-axial nozzle would be required. Due to the shape of the slot nozzle, it does not lend itself immediately to this approach. However, there are two 'shoulders' of the slot nozzle, where the process gas expands through the narrow gap into the larger oblate section. The CFD analysis suggests that the 'shoulders' of the nozzle generate vortices which improve the dispersion of the process gas into the burner section and thus improve DRE. Any side lance injection into this region of the nozzle will ideally not disrupt this function.

Although embodiments are described with reference to the inlet assembly described with reference to FIG. 9, it will be appreciated that secondary gas streams could also be provided by locating secondary gas outlets at similar positions on the inlet assemblies illustrated with reference to FIGS. 1 to 7.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. An inlet assembly for a burner, said inlet assembly comprising:

an inlet nozzle defining an inlet aperture coupleable with an inlet conduit providing an effluent gas stream for treatment by said burner, a non-circular outlet aperture, a nozzle bore extending along a longitudinal axis between said inlet aperture and said outlet aperture for conveying said effluent gas stream from said inlet aperture to said outlet aperture for delivery to a combustion chamber of said burner, said nozzle bore having an inlet portion extending from said inlet aperture and an outlet portion extending to said non-circular outlet aperture, a baffle coupling said inlet portion with said outlet portion, said baffle defining a baffle aperture positioned within said nozzle bore, said baffle aperture having a reduced cross-sectional area compared to that of said outlet portion adjacent said baffle, and a secondary gas stream nozzle coupleable with a secondary gas stream conduit providing a secondary gas stream, said secondary gas stream nozzle being positioned to mix said secondary gas stream with said effluent gas stream within said nozzle bore wherein said baffle aperture is configured to generate a vortex in said effluent gas stream within said outlet portion and said secondary gas stream nozzle is positioned to inject said secondary gas stream to flow tangentially with a direction of flow of said vortex.

2. The inlet assembly as claimed in claim 1, wherein said secondary gas stream nozzle is positioned proximate said baffle.

3. The inlet assembly as claimed in claim 1, wherein said secondary gas stream nozzle is positioned within at least one of said inlet portion and said outlet portion.

4. The inlet assembly as claimed in claim 1, wherein said secondary gas stream nozzle is orientated to inject said secondary gas stream at an angle of between 10° and 40°.

5. The inlet assembly as claimed in claim 1, wherein said outlet aperture is elongate, extending along a major axis and secondary gas stream nozzle is orientated to inject said secondary gas stream within a plane defined by said major axis.

6. The inlet assembly as claimed in claim 1, wherein said secondary gas stream nozzle is positioned within said outlet portion, proximate said baffle aperture.

7. The inlet assembly as claimed in claim 1, comprising a plurality of said gas stream nozzles.

8. The inlet assembly as claimed in claim 1, wherein said baffle aperture is configured to generate a plurality of vortices in said effluent gas stream within said outlet portion and each secondary gas stream nozzle is positioned to inject said secondary gas stream to flow tangentially to one of said vortices.

9. An inlet assembly for a burner, said inlet assembly comprising:

an inlet nozzle defining an inlet aperture coupleable with an inlet conduit providing an effluent gas stream for treatment by said burner, a non-circular outlet aperture, a nozzle bore extending along a longitudinal axis between said inlet aperture and said outlet aperture for conveying said effluent gas stream from said inlet aperture to said outlet aperture for delivery to a combustion chamber of said burner, said nozzle bore having an inlet portion extending from said inlet aperture and an outlet portion extending to said non-circular outlet aperture, a baffle coupling said inlet portion with said outlet portion, said baffle defining a baffle aperture positioned within said nozzle bore, said baffle aperture having a reduced cross-sectional area compared to that of said outlet portion adjacent said baffle, and a secondary gas stream nozzle coupleable with a secondary gas stream conduit providing a secondary gas stream, said secondary gas stream nozzle being positioned to mix said secondary gas stream with said effluent gas stream within said nozzle bore wherein said baffle aperture is configured to generate a vortex in said effluent gas stream within said outlet portion and wherein said vortex has an inner flow region proximate said baffle aperture and an outer flow region proximate said outlet portion nozzle bore and said secondary gas stream nozzle is positioned to inject said secondary gas stream to flow tangentially with a direction of flow of said vortex in said inner flow region.

* * * * *